US012320278B2

(12) United States Patent
Sugano

(10) Patent No.: US 12,320,278 B2
(45) Date of Patent: Jun. 3, 2025

(54) VALVE TIMING CHANGING DEVICE

(71) Applicant: MIKUNI CORPORATION, Tokyo (JP)

(72) Inventor: Kouji Sugano, Kanagawa (JP)

(73) Assignee: MIKUNI CORPORATION, Tokyo (JP)

( * ) Notice: Subject to any disclaimer, the term of this patent is extended or adjusted under 35 U.S.C. 154(b) by 0 days.

(21) Appl. No.: 18/659,006

(22) Filed: May 9, 2024

(65) Prior Publication Data

US 2024/0392706 A1 Nov. 28, 2024

(30) Foreign Application Priority Data

May 26, 2023 (JP) ..... 2023-087048

(51) Int. Cl.
*F01L 1/344* (2006.01)
*F01L 1/46* (2006.01)
*F01L 1/047* (2006.01)

(52) U.S. Cl.
CPC ..... *F01L 1/46* (2013.01); *F01L 1/3442* (2013.01); *F01L 1/047* (2013.01); *F01L 2001/34453* (2013.01); *F01L 2001/34456* (2013.01); *F01L 2001/34469* (2013.01); *F01L 2301/00* (2020.05); *F01L 2800/15* (2013.01)

(58) Field of Classification Search
CPC ..... F01L 1/047; F01L 1/3442; F01L 2001/34453; F01L 2001/34456; F01L 2001/34469; F01L 2301/00; F01L 2800/15
USPC ..... 123/90.17
See application file for complete search history.

(56) References Cited

U.S. PATENT DOCUMENTS

| | | | | |
|---|---|---|---|---|
| 2010/0162977 | A1 | 7/2010 | Strandburg, III et al. | |
| 2016/0273417 | A1* | 9/2016 | Watanabe | F02D 13/0203 |
| 2020/0095947 | A1* | 3/2020 | Murasaka | F02D 13/02 |
| 2022/0010694 | A1* | 1/2022 | Kawamura | F16K 11/0716 |

FOREIGN PATENT DOCUMENTS

| | | |
|---|---|---|
| JP | H11218008 | 8/1999 |
| JP | 2001227307 | 8/2001 |
| JP | 2002030908 | 1/2002 |
| JP | 5022327 | 9/2012 |

* cited by examiner

*Primary Examiner* — Jorge L Leon, Jr.
(74) *Attorney, Agent, or Firm* — JCIPRNET

(57) ABSTRACT

The valve timing changing device includes a vane rotor 10 that rotates integrally with a camshaft around an axis S of the camshaft and includes a lock pin 42; and a housing rotor Hr that is rotatable relative to the vane rotor around the axis within the range of a predetermined movable angle Δθ and whose relative rotation is locked by the lock pin. The housing rotor Hr includes a toothed member 30 having a tooth row 31 to which a driving force is applied, and a bottomed cylindrical housing member 20 fixed to the toothed member and accommodating the vane rotor. The housing member 20 is formed with a center of gravity eccentric from the axis S on a side that relatively reduces an imbalance amount m1 of the vane rotor.

14 Claims, 18 Drawing Sheets

VALVE TIMING CHANGING DEVICE

CROSS-REFERENCE TO RELATED APPLICATION

This application claims the priority benefits of Japanese application no. 2023-087048, filed on May 26, 2023. The entirety of the above-mentioned patent application is hereby incorporated by reference herein and made a part of this specification.

BACKGROUND

Technical Field

The disclosure relates to a valve timing changing device that changes the opening/closing timing of an intake valve or an exhaust valve of an internal combustion engine according to operating conditions.

Description of Related Art

As a conventional valve timing changing device, there is a valve timing control device for an internal combustion engine (see, for example, Patent Document 1 (Japanese Patent Application Laid-Open No. 2001-227307), etc.), which includes a housing member and a chain sprocket (housing rotor) that rotate in synchronization with a crankshaft on the axis of a camshaft, a vane member (vane rotor) that rotates integrally with the camshaft and can rotate within the range of a predetermined angle relative to the housing rotor, and a rotation regulating means (lock pin) that is provided on the vane rotor to regulate relative rotation between the vane rotor and the housing rotor. In order to reduce the unbalanced mass (imbalance amount during rotation) around the axis of the vane rotor due to the lock pin, the chain sprocket is provided with an opening or a cutout portion as a lightweight portion.

In this device, the imbalance amount is adjusted only by the chain sprocket that forms a part of the housing rotor, but the adjustment made based on an opening or a cutout portion has limitations in terms of strength or structure, and there is a possibility that the imbalance amount cannot be sufficiently reduced.

Besides, as another valve timing changing device, there is a valve timing control device for an internal combustion engine (see, for example, Patent Document 2 (Japanese Patent Application Laid-Open No. 2002-30908), etc.), which similarly includes a housing member and a chain sprocket (housing rotor), a vane member (vane rotor), and a lock pin. In order to reduce the unbalanced mass (imbalance amount) around the axis of the vane rotor due to the lock pin, in the vane rotor, the blade portion provided with the lock pin and the blade portion at the symmetrical position are balanced.

In this device, the imbalance amount is adjusted only by the vane rotor, but there is a limit to the imbalance amount that can be reduced for the entire device, in which the vane rotor is accommodated and assembled into the housing rotor, due to variations in assembly and manufacturing.

The disclosure provides a valve timing changing device that is capable of reducing or eliminating the imbalance amount during rotation with a simple structure without increasing the size and weight.

SUMMARY

A valve timing changing device according to the disclosure is configured to change an opening/closing timing of an intake valve or an exhaust valve driven by a camshaft. The valve timing changing device includes: a vane rotor that rotates integrally with the camshaft around an axis of the camshaft and includes a lock pin; and a housing rotor that is rotatable relative to the vane rotor around the axis within a range of a predetermined movable angle and whose relative rotation is locked by the lock pin. The housing rotor includes a toothed member having a tooth row to which a driving force is applied, and a housing member in a bottomed cylindrical shape which is fixed to the toothed member and accommodates the vane rotor. The housing member is formed with a center of gravity eccentric from the axis on a side opposite to a side where an imbalance amount of the vane rotor occurs to relatively reduce an imbalance amount of the vane rotor.

In the above valve timing changing device, the housing member may have an inner peripheral surface centered on the axis, and an outer peripheral surface centered on a biased axis which is biased in parallel to the axis.

In the above valve timing changing device, the vane rotor may include a vane portion in which the lock pin is arranged and which moves within the range of the movable angle, and an orthogonal line orthogonal to the axis and the biased axis may be located within a region which forms a diagonal angle with the movable angle with respect to the axis.

In the above valve timing changing device, the orthogonal line may be located at an angular position in a center of the diagonal angle.

In the above valve timing changing device, the vane rotor may include a vane portion in which the lock pin is arranged, the housing member may include a pair of shoe portions which protrude from the inner peripheral surface to restrict movement of the vane portion within the range of the movable angle, and an orthogonal line orthogonal to the axis and the biased axis may be located on a straight line that is perpendicular to the axis and passes through a center of a spatial region defined by the pair of shoe portions.

In the above valve timing changing device, the toothed member may include a disc-shaped protrusion which protrudes in a direction of the axis, the housing member may include an annular recess into which the disc-shaped protrusion is fitted, and the outer peripheral surface may be formed in an outer region outside the annular recess.

In the above valve timing changing device, the toothed member may be formed with a center of gravity eccentric from the axis on a side opposite to a side where an imbalance amount of the vane rotor occurs to relatively reduce the imbalance amount of the vane rotor.

In the above valve timing changing device, the toothed member may include a cutout portion formed to relatively reduce the imbalance amount of the vane rotor.

In the above valve timing changing device, the center of gravity of the toothed member may be located within the region which forms the diagonal angle with the movable angle with respect to the axis.

In the above valve timing changing device, the center of gravity of the toothed member may be located at the angular position in the center of the diagonal angle.

In the above valve timing changing device, the vane rotor may be made of an aluminum material, the toothed member may be made of an iron-based material, and the housing member may be made of an aluminum material.

In the above valve timing changing device, the range of the movable angle may define a most retarded position at one end thereof and a most advanced position at the other end thereof, and the lock pin may lock the housing member at the most retarded position.

With the valve timing changing device having the above configuration, the imbalance amount can be reduced or eliminated with a simple structure without increasing the size and weight.

DESCRIPTION OF THE EMBODIMENTS

Embodiments of the disclosure will be described hereinafter with reference to the accompanying drawings.

Figure 1:
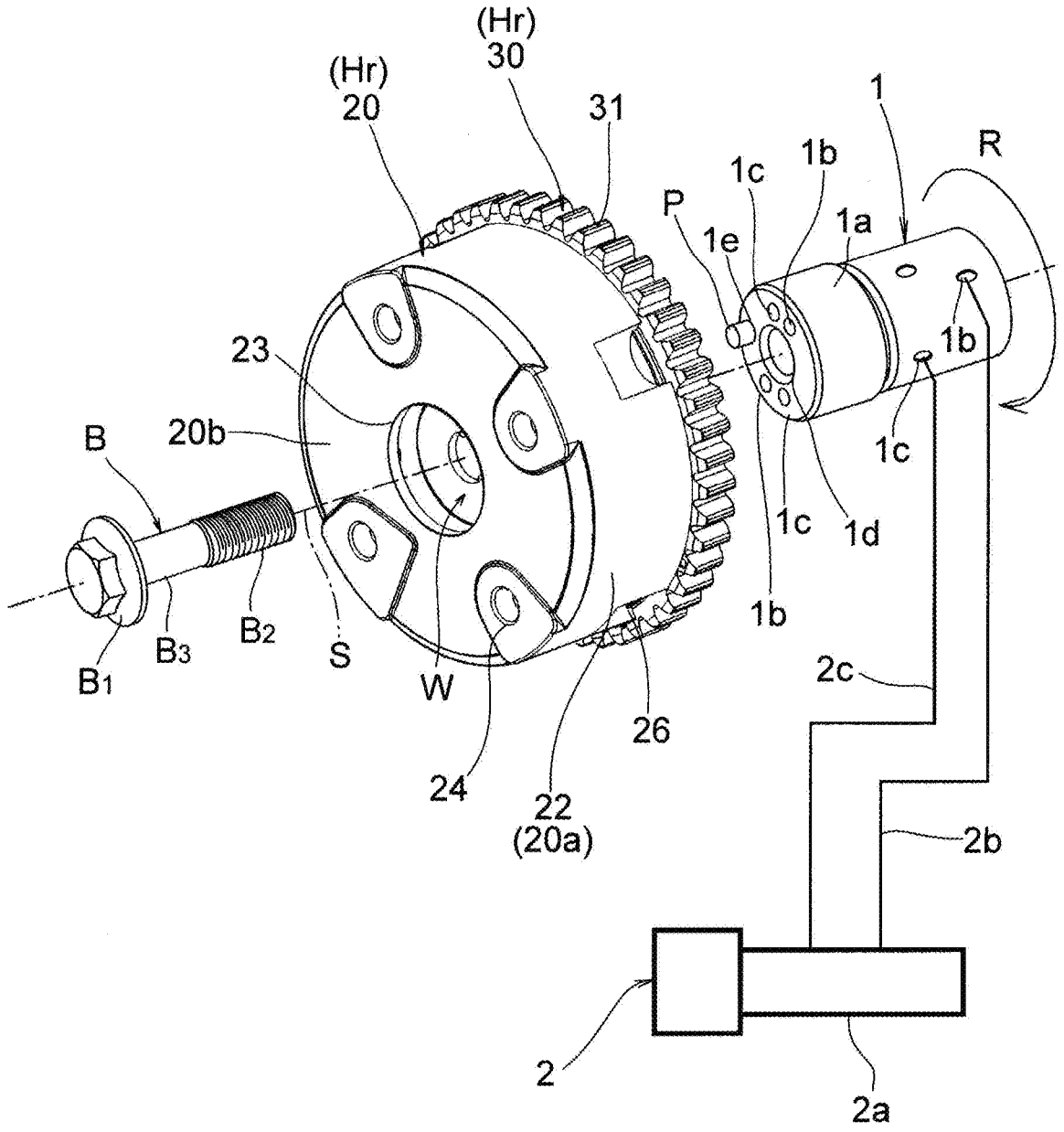
FIG. 1 is an exploded perspective view of the valve timing changing device according to an embodiment of the disclosure, as viewed diagonally from the front, showing a state before the valve timing changing device is mounted on the camshaft of the internal combustion engine.
Figure 2:
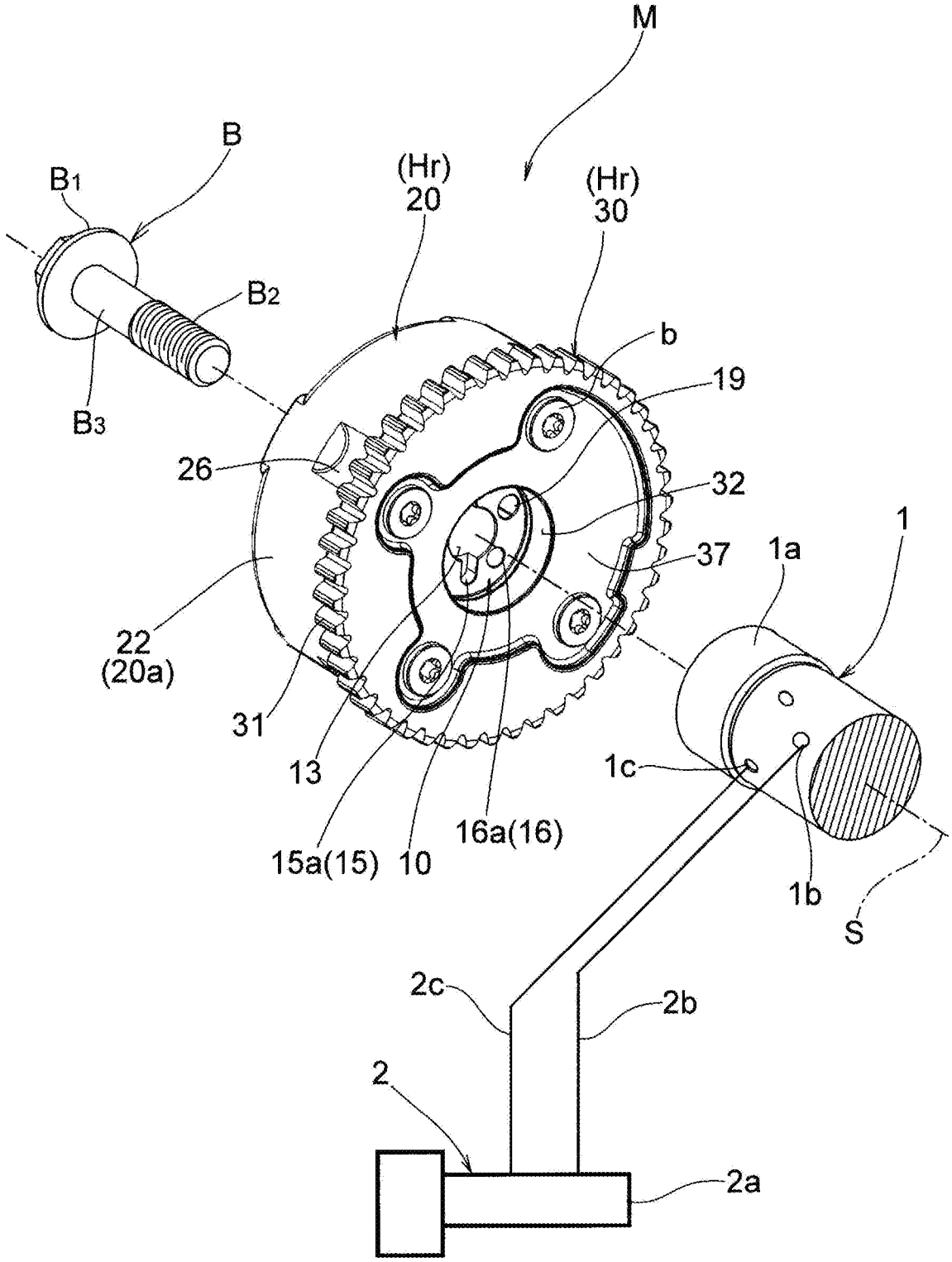
FIG. 2 is an exploded perspective view of the valve timing changing device according to an embodiment of the disclosure, as viewed diagonally from the rear, showing a state before the valve timing changing device is mounted on the camshaft of the internal combustion engine.

A valve timing changing device M according to an embodiment is configured to be mounted on a camshaft 1 of an internal combustion engine, as shown in FIG. 1 and FIG. 2. As shown in FIG. 3 to FIG. 7, the valve timing changing device M includes a vane rotor 10, a housing rotor Hr, a washer W, and a lock unit 40 for locking the housing rotor Hr to the vane rotor 10.

Here, the housing rotor Hr includes a housing member 20 and a toothed member 30 fixed to the housing member 20 with screws b.

The camshaft 1 is rotatably supported around an axis S by a bearing formed in a cylinder head of the internal combustion engine, and rotates in the direction of the arrow R to open and close an intake valve or an exhaust valve by a cam action. In addition, as shown in FIG. 1 and FIG. 2, the camshaft 1 includes a circular shaft portion 1*a* that rotatably supports the housing rotor Hr, an advance passage 1*b* that supplies and discharges hydraulic oil, a retard passage 1*c* that supplies and discharges hydraulic oil, a female screw hole 1*d* into which a bolt B is screwed, and a fitting hole 1*e* into which a positioning pin P is fitted.

The bolt B is made of a hard iron-based metal material and includes a head portion $B_1$ with a flange, a screw portion $B_2$, and a lower neck portion $B_3$.

Then, in a state where the vane rotor 10 is fixed to the camshaft 1 using the bolt B, the housing rotor Hr is linked to the rotation of a crankshaft via a chain or the like, the rotational driving force of the crankshaft is transmitted to the camshaft 1 via the vane rotor 10, and the camshaft 1 is connected to a hydraulic control system 2 that controls the flow of hydraulic oil for the valve timing changing device M to function to change the valve timing in the internal combustion engine.

As shown in FIG. 1 and FIG. 2, the hydraulic control system 2 includes a hydraulic control valve 2*a* that controls the flow of hydraulic oil discharged from a pump, an advance side passage 2*b* that connects the hydraulic control valve 2*a* and the advance passage 1*b*, a retard side passage 2*c* that connects the hydraulic control valve 2*a* and the retard passage 1*c*, and a control means (not shown) that controls the drive of the hydraulic control valve 2*a*.

Figure 3:
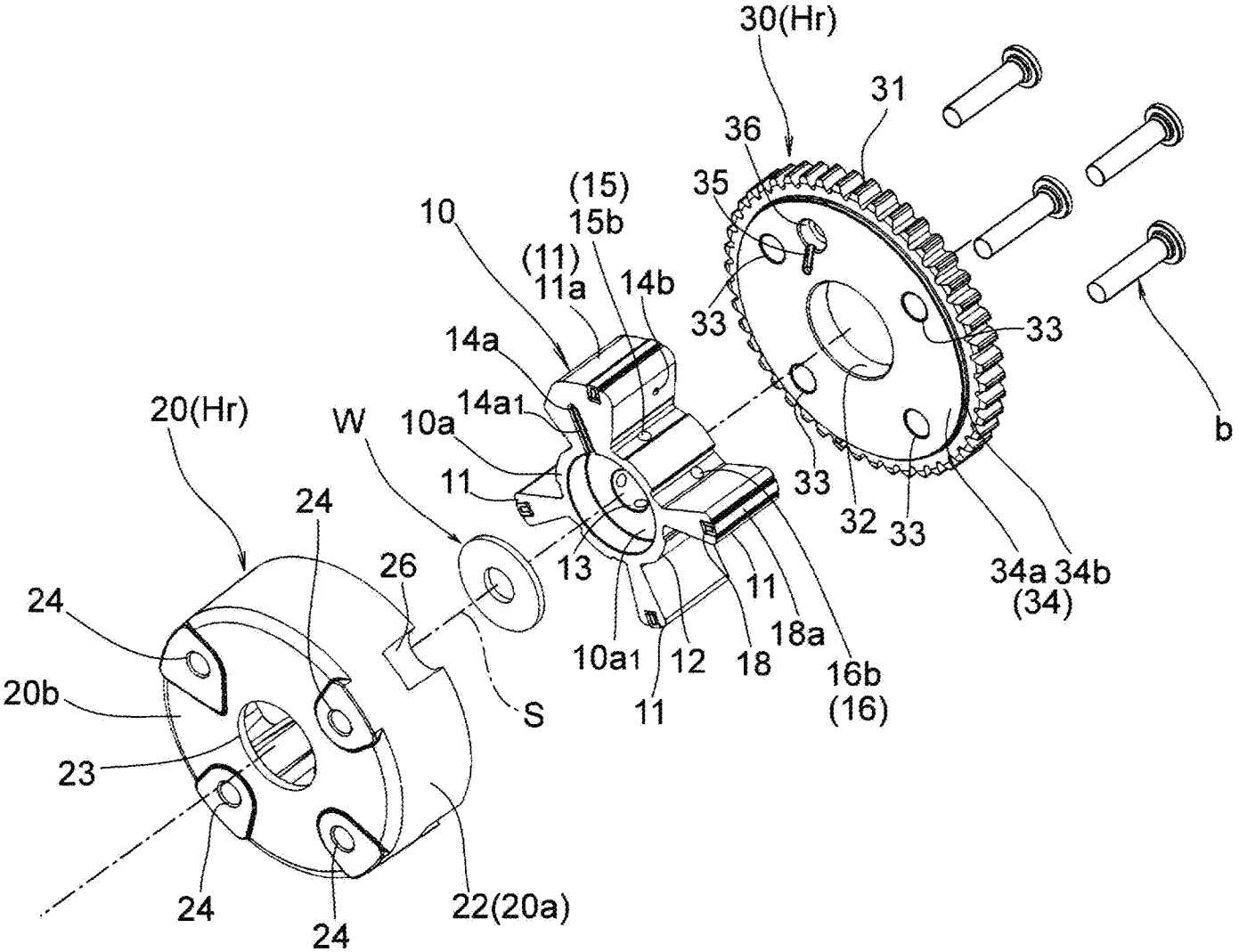
FIG. 3 is an exploded perspective view of the valve timing changing device according to an embodiment, as viewed diagonally from the front.
Figure 4:
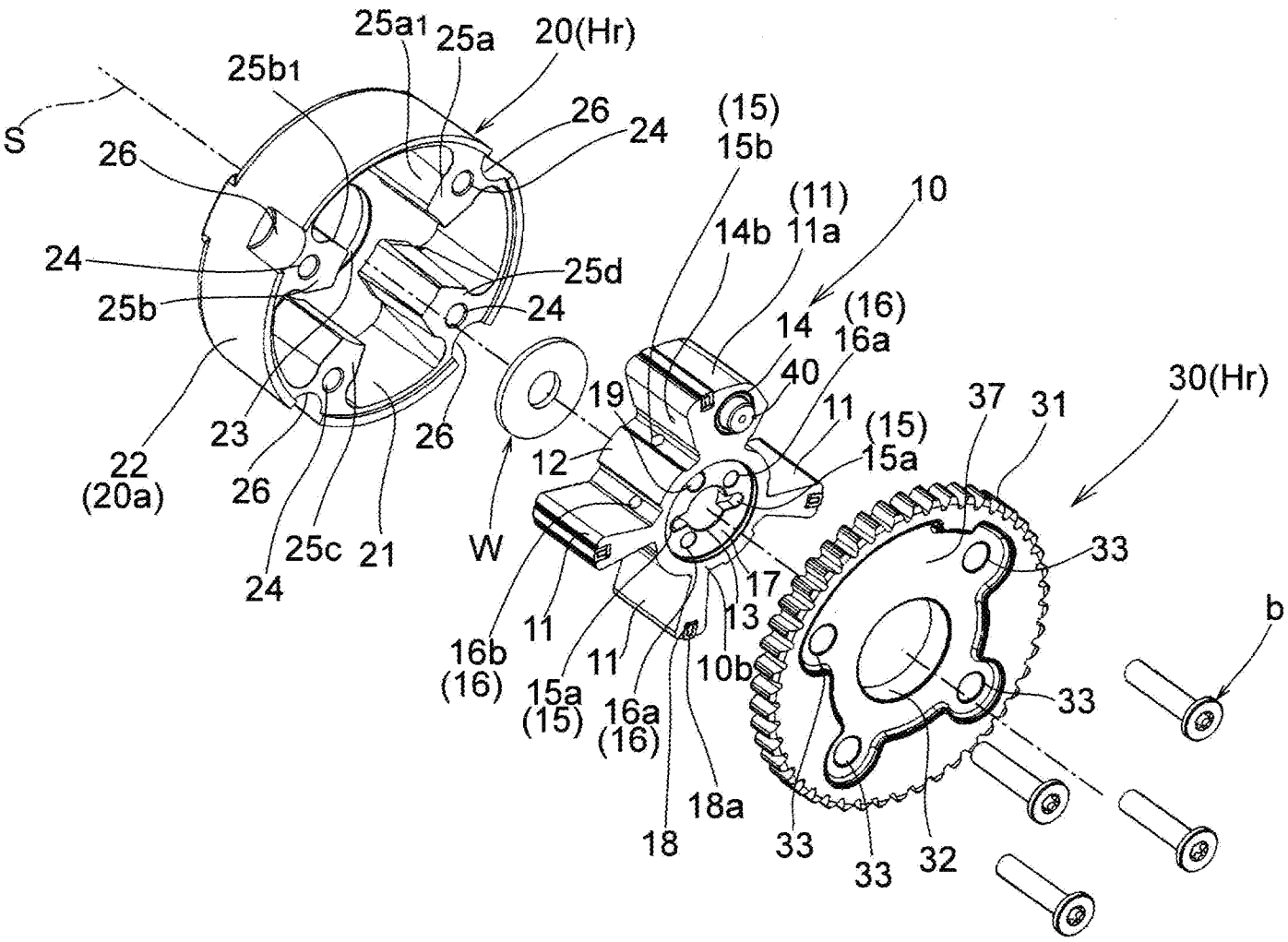
FIG. 4 is an exploded perspective view of the valve timing changing device according to an embodiment, as viewed diagonally from the rear.

The vane rotor 10 is formed using an aluminum material that is softer than the iron-based material. As shown in FIG. 3 and FIG. 4, the vane rotor 10 includes a front surface 10*a* and a rear surface 10*b*, four vane portions 11, a columnar hub portion 12, a through hole 13, a mounting hole 14 for mounting the lock unit 40, a retard passage 15, an advance passage 16, a fitting recess 17 for fitting the camshaft 1, four sealing insertion grooves 18 formed at the tips of the vane portions 11, and a positioning hole 19 into which the positioning pin P of the camshaft 1 is fitted.

The front surface 10*a* is a flat surface perpendicular to the axis S, and defines the front end surfaces of the four vane portions 11 and the hub portion 12. Then, the front surface 10*a* in the regions of the vane portions 11 and the outer region of the hub portion 12 is slidably in contact with the inner wall surface of the housing rotor Hr in the direction of the axis S. Further, the bottom surface of an annular recess 10$a_1$ in the inner region of the hub portion 12 functions as a seat surface against which the washer W abuts.

The rear surface 10*b* is a flat surface perpendicular to the axis S, and defines rear end surfaces of the four vane portions 11 and the hub portion 12. Then, the rear surface 10*b* is slidably in contact with the inner wall surface (end surface 34*a*) of the housing rotor Hr in the direction of the axis S.

The four vane portions 11 are arranged radially apart from the hub portion 12 in the circumferential direction. One vane portion 11*a* has a larger width dimension in the circumferential direction than the other three vane portions 11, and is provided with the mounting hole 14 for mounting the lock unit 40. That is, the lock unit 40 is arranged in the vane portion 11*a*, which is a region where unbalanced mass (imbalance amount) occurs.

The hub portion 12 is fixed to the camshaft 1 with the bolt B via the washer W.

The through hole 13 is formed as a circular hole that penetrates from the annular recess 10$a_1$ formed in the front surface 10*a* to the rear surface 10*b* with the axis S as the center, for the screw portion $B_2$ and the lower neck portion $B_3$ of the bolt B to pass in a non-contact manner and defining a hydraulic oil passage around the lower neck portion $B_3$.

The mounting hole 14 opens on the rear surface 10*b* and is formed for a cylindrical holder 41 of the lock unit 40 to be fitted therein. Furthermore, passages 14*a* and 14*b* for adjusting pressure are formed in the mounting hole 14 so as to communicate with each other. The passage 14*a* communicates with a long groove 14$a_1$ formed in the front surface 10*a* to communicate with the outside through an opening 23. The passage 14*b* opens on the side surface of the vane portion 11*a*, communicates with a retard chamber RC, and supplies hydraulic oil in the retard chamber RC that acts in a direction to bury a lock pin 42.

Figure 6:
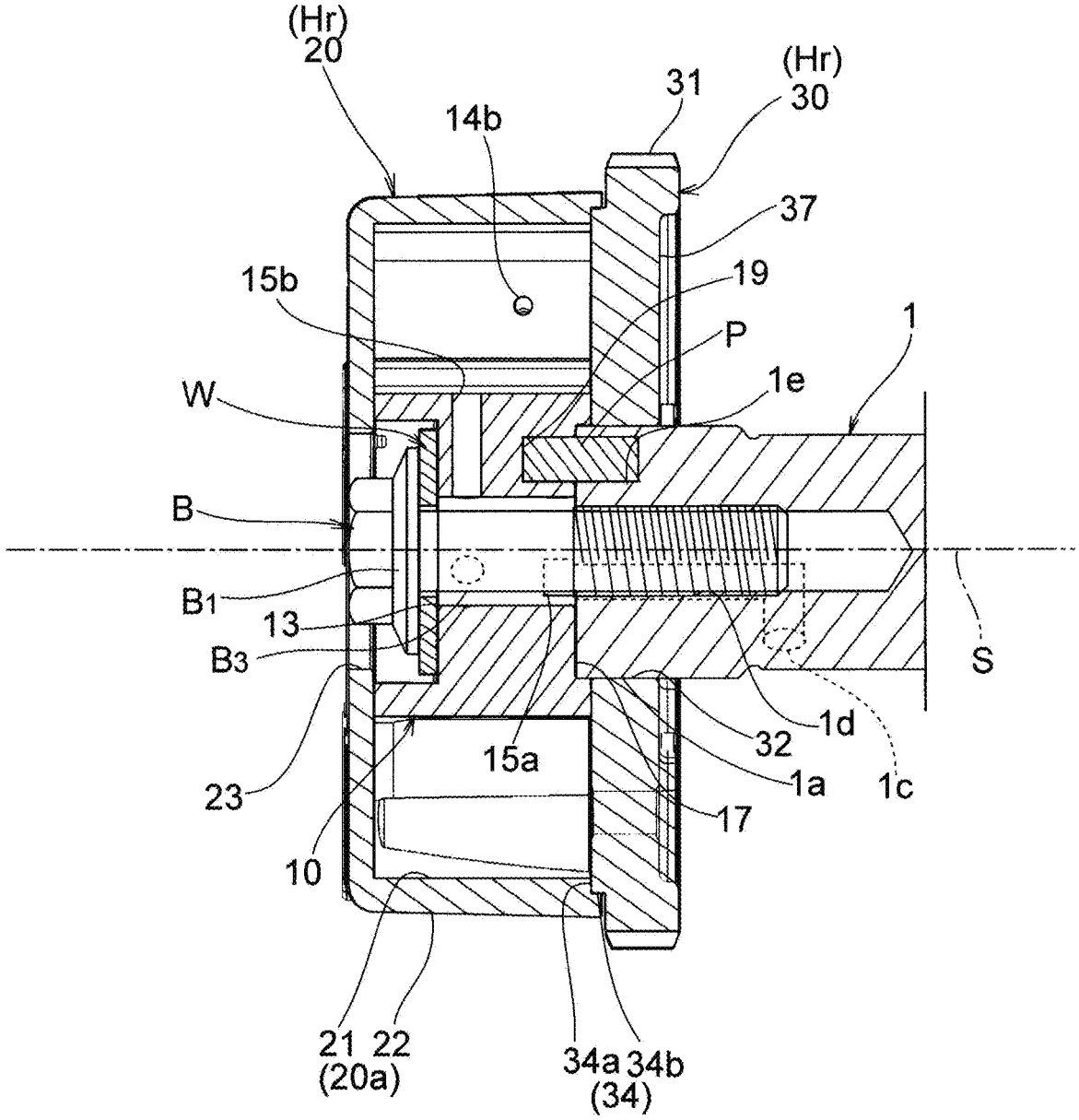
FIG. 6 is a cross-sectional view showing a state where the valve timing changing device according to an embodiment is mounted on the camshaft.
Figure 16:
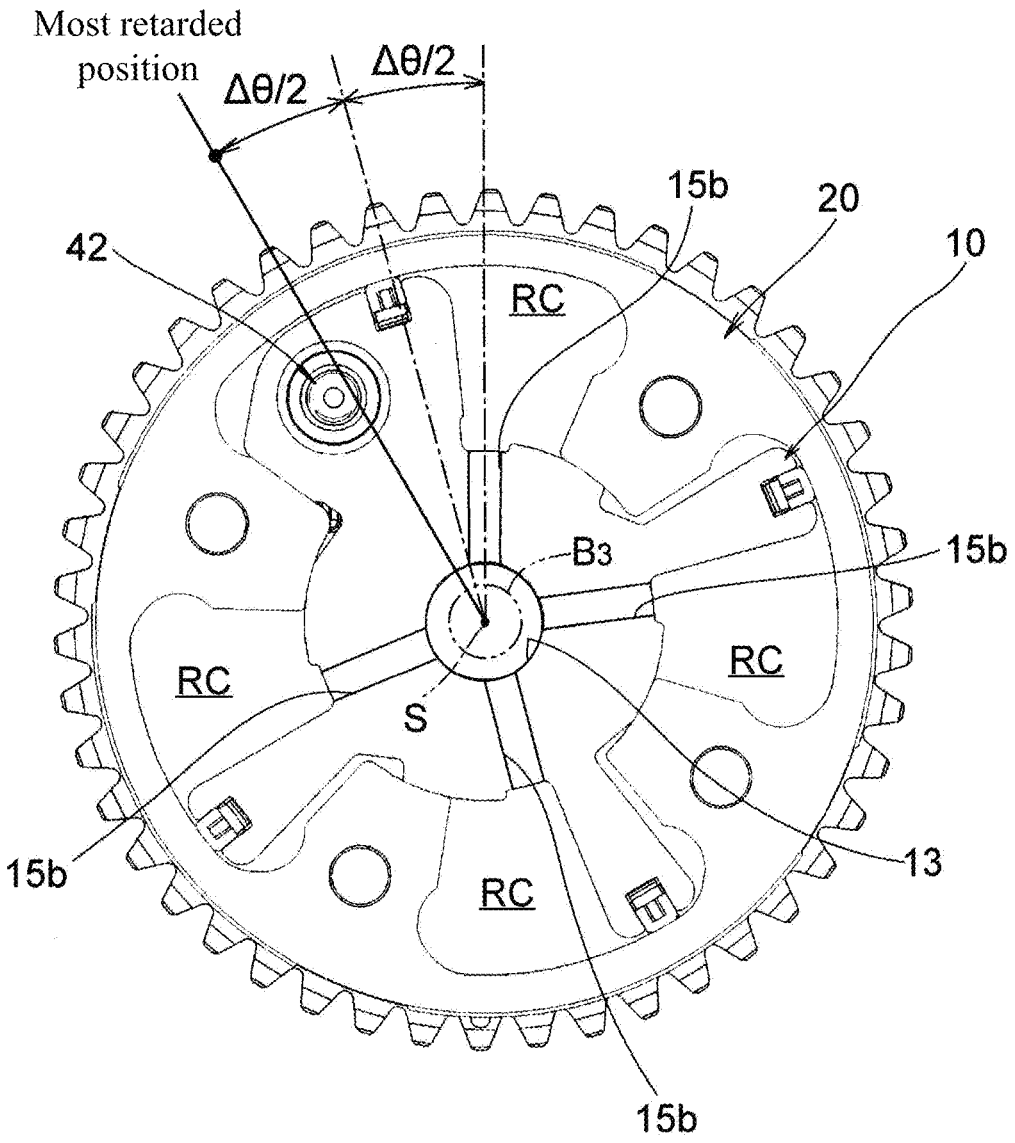
FIG. 16 is a cross-sectional view showing a state where the vane rotor is at the most retarded position and the retard passage in the valve timing changing device according to an embodiment.

As shown in FIG. 4, FIG. 6, and FIG. 16, the retard passage 15 is formed by two groove-shaped passages 15*a* that are formed on the bottom surface of the fitting recess 17 and communicate with the retard passage 1*c* of the camshaft 1, and four passages 15*b* that open on the outer peripheral surface of the hub portion 12. The retard passage 15 supplies hydraulic oil to the retard chamber RC and discharges hydraulic oil from the retard chamber RC via the passage defined around the lower neck portion $B_3$ of the bolt B in the through hole 13.

Figure 7:
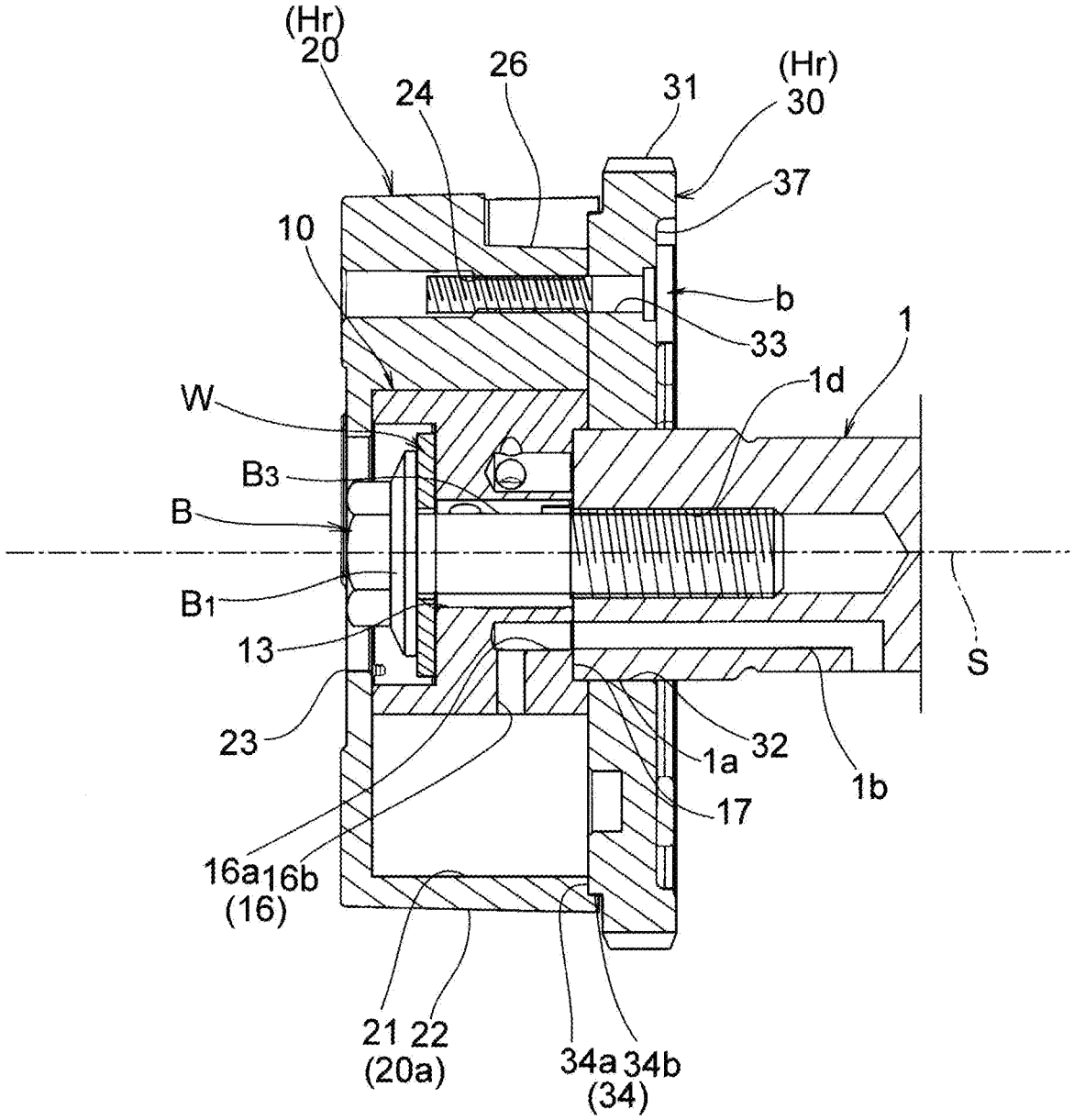
FIG. 7 is a cross-sectional view showing a state where the valve timing changing device according to an embodiment is mounted on the camshaft.
Figure 17:
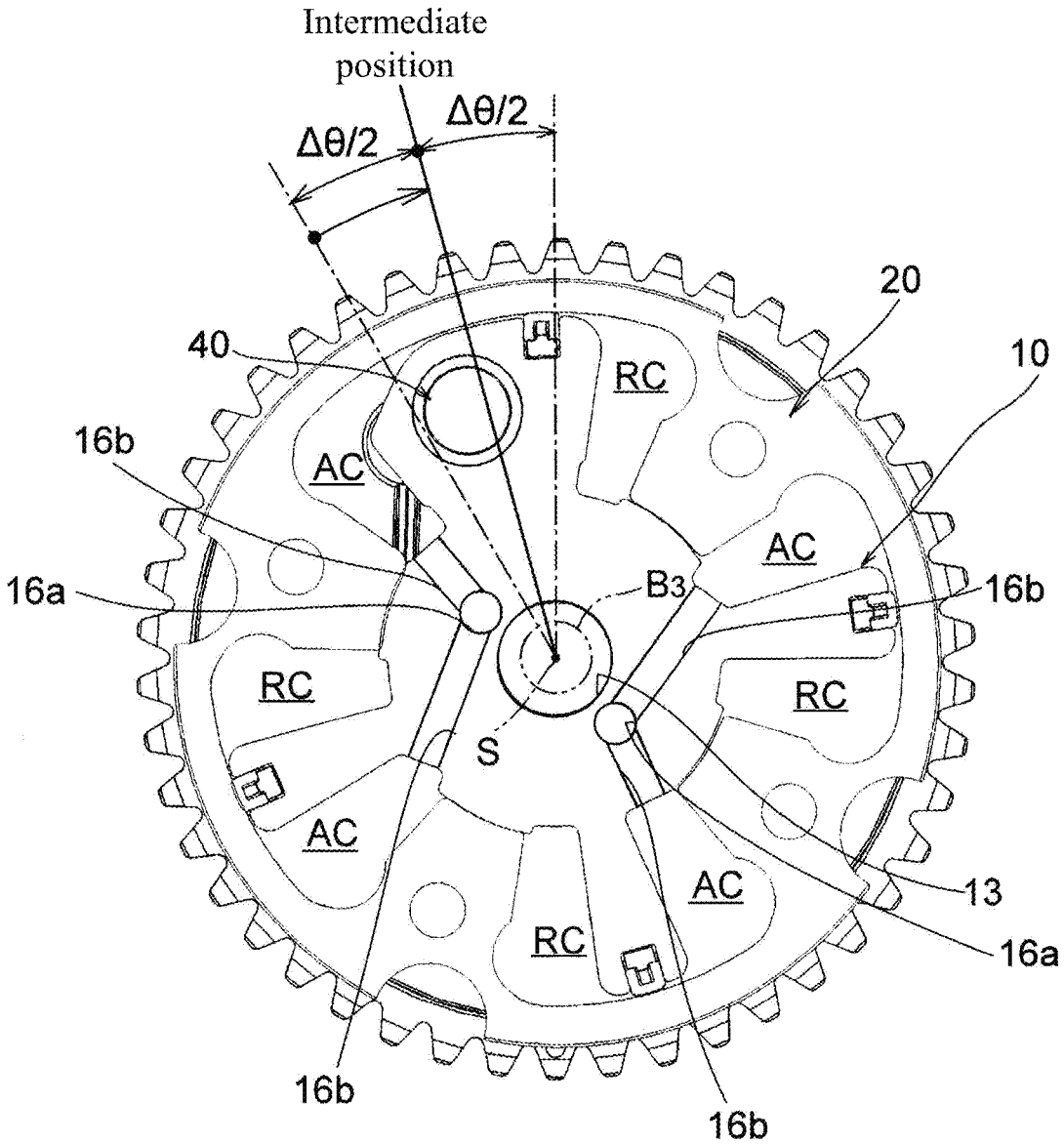
FIG. 17 is a cross-sectional view showing a state where the vane rotor is at the intermediate position and the advance passage in the valve timing changing device according to an embodiment.

As shown in FIG. 4, FIG. 7, and FIG. 17, the advance passage 16 is formed by two passages 16*a* that open on the bottom surface of the fitting recess 17 and extend in the direction of the axis S to communicate with the advance passage 1*b* of the camshaft 1, and four passages 16*b* that open on the outer peripheral surface of the hub portion 12. The advance passage 16 supplies hydraulic oil to an advance chamber AC and discharges hydraulic oil from the advance chamber AC.

The fitting recess 17 is formed as a cylindrical recess on the side of the rear surface 10*b* of the vane rotor 10 so as to fit the front end portion of the shaft portion 1*a* of the camshaft 1 therein.

The sealing insertion groove 18 is formed to have a rectangular cross section, and a sealing member 18*a* that is slidably in contact with the inner peripheral surface 21*f* of the housing rotor 20 is fitted into the sealing insertion groove 18.

Figure 18:
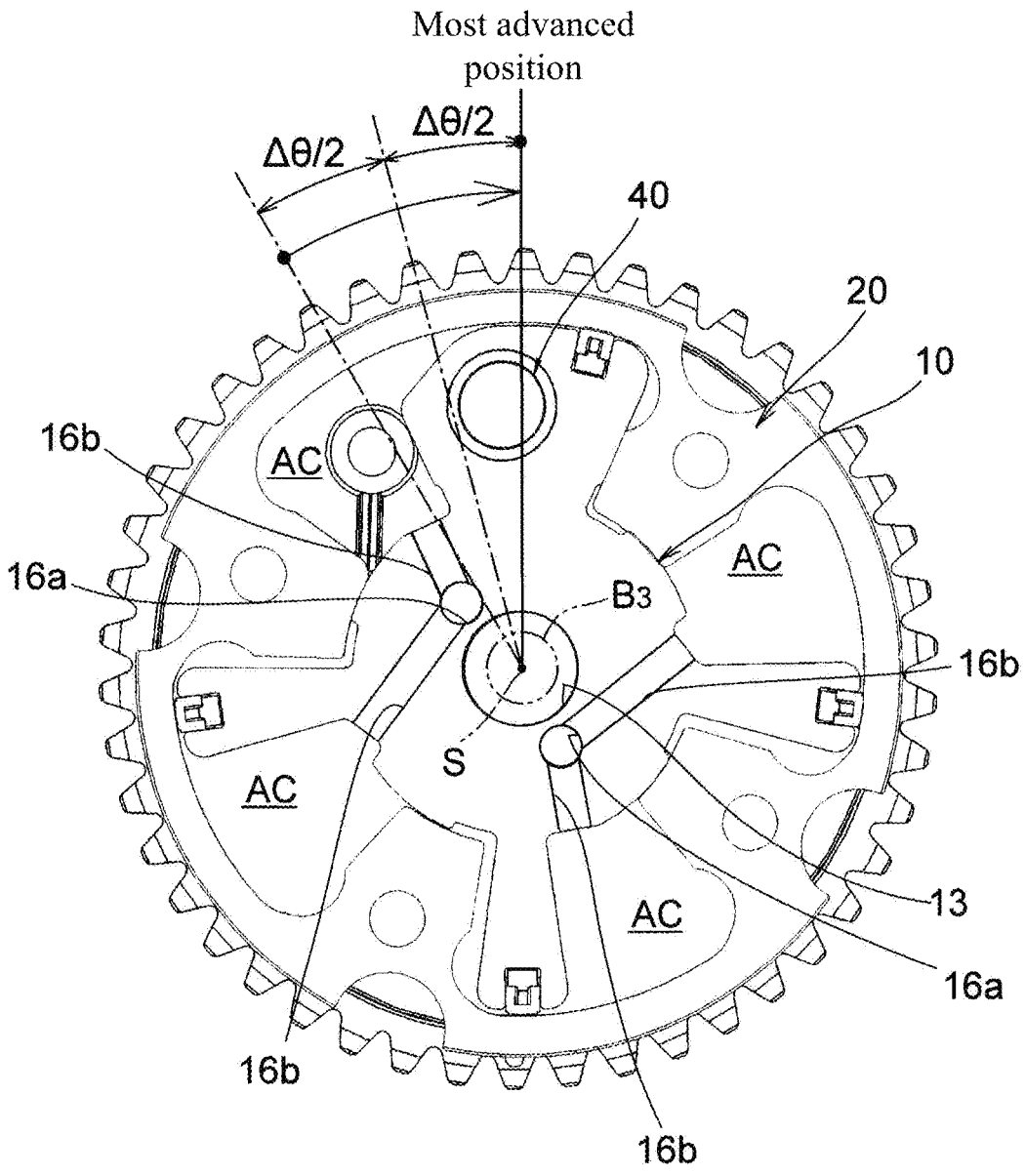
FIG. 18 is a cross-sectional view showing a state where the vane rotor is at the most retarded position and the advance passage in the valve timing changing device according to an embodiment.

Also, the vane rotor 10 is accommodated in the accommodation chamber (spatial region A) of the housing rotor Hr to be relatively rotatable within the range of a predetermined movable angle Δθ, that is, within the range of the movable angle Δθ between the most retarded position shown in FIG. 16 and the most advanced position shown in FIG. 18, divides the accommodation chamber into the advance chamber AC and the retard chamber RC, and is fixed to the camshaft 1 by the bolt B via the washer W to rotate integrally with the camshaft 1.

In the vane rotor 10 having the above configuration, the lock unit 40 is arranged in the vane portion 11*a*, and the circumferential dimension around the axis S is formed larger than the other vane portions 11. Therefore, when the vane rotor 10 rotates around the axis S, unbalanced mass, that is, an imbalance amount, occurs in the region of the vane portion 11*a*.

The housing member 20 is formed by die casting using an aluminum material or as a sintered body into a bottomed cylindrical shape that has a cylindrical wall 20*a* and a front wall 20*b*.

As shown in FIG. 3 to FIG. 8, the housing member 20 includes an inner peripheral surface 21 and an outer peripheral surface 22 defining the cylindrical wall 20*a*, the opening 23 formed in the front wall 20*b*, four screw holes 24 into which the screws b are inserted, a shoe portion 25 protruding inward from the inner peripheral surface 21, four outer recesses 26, an annular end surface 27, and an annular recess 28.

The inner peripheral surface 21 is formed as a part of a cylindrical surface centered on the axis S, and the sealing member 18*a* is slidably in contact with the inner peripheral surface 21.

Figure 8:
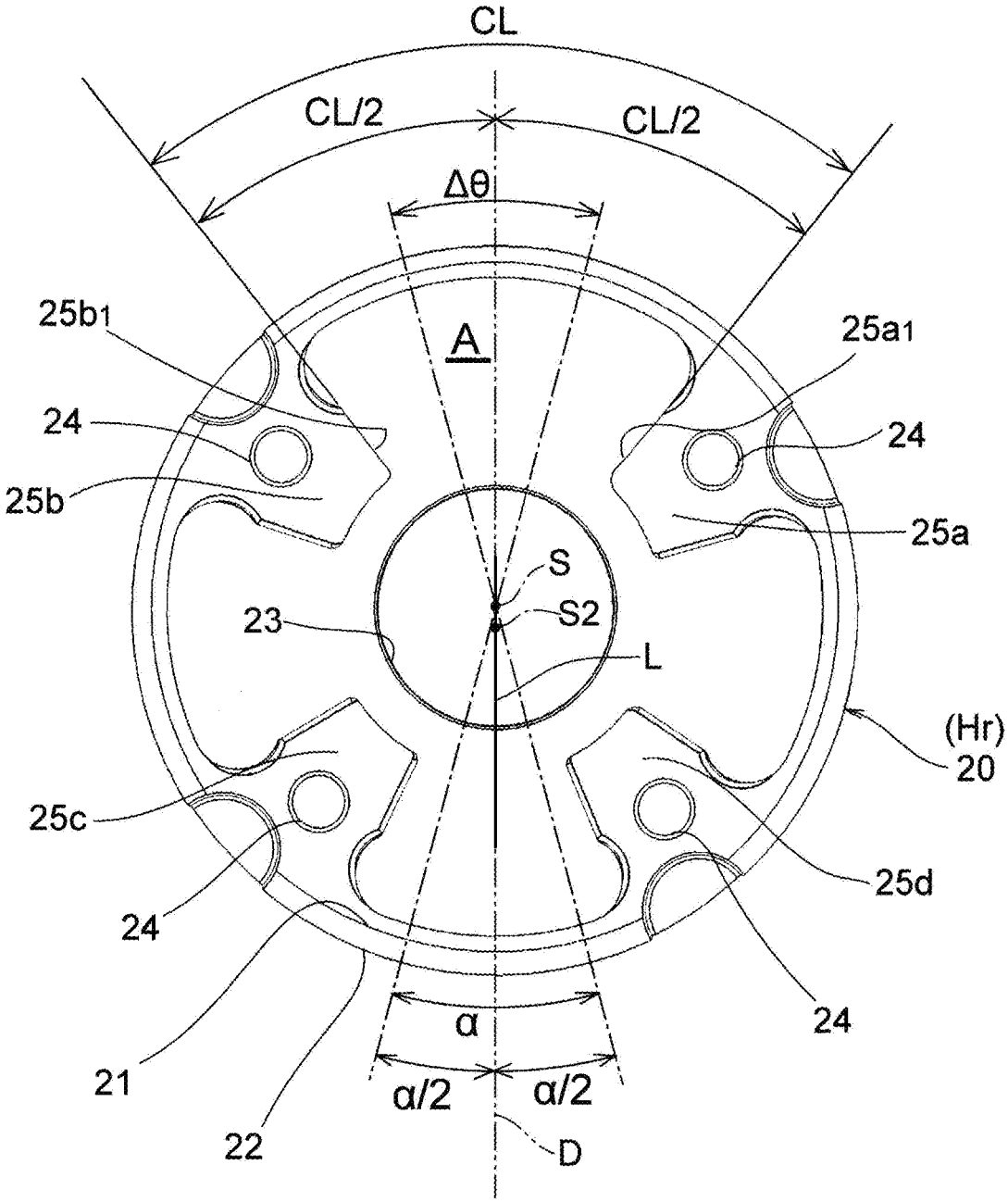
FIG. 8 is a rear view of the inside of the housing member constituting the housing rotor, as viewed from the rear side in the axial direction, in the valve timing changing device according to an embodiment.

As shown in FIG. 8, the outer peripheral surface 22 is formed as a cylindrical surface centered on a biased axis S2 that is parallel to the axis S and is biased by a predetermined amount.

Figure 9:
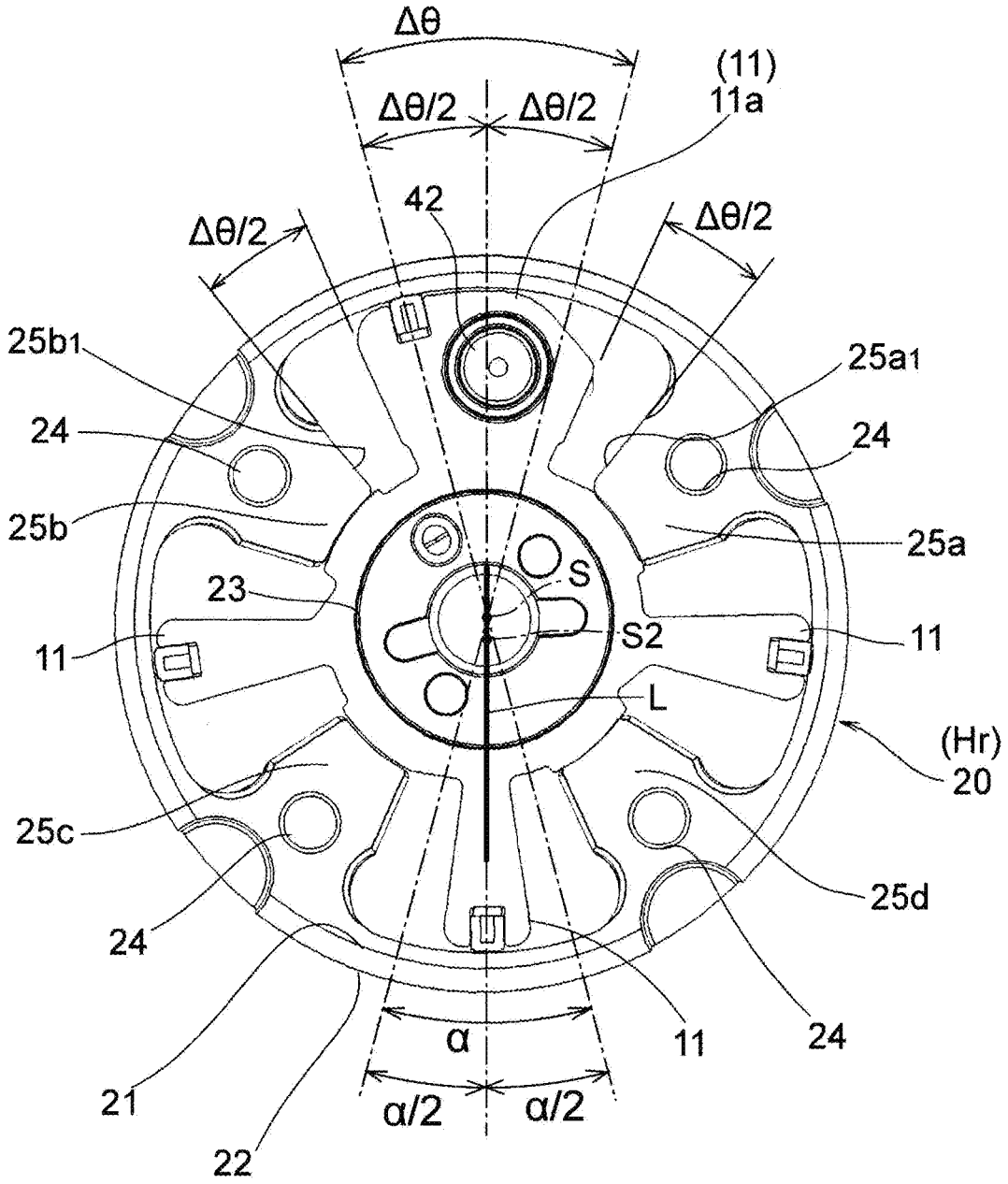
FIG. 9 is a rear view of the inside with the toothed member removed, as viewed from the rear side in the axial direction, in a state where the vane rotor is located at the intermediate position of the angle range in the valve timing changing device according to an embodiment.

Further, as shown in FIG. 8 and FIG. 9, an orthogonal line L that is orthogonal to the axis S and the biased axis S2 is located at an angular position in the center of a diagonal angle α in a region that forms the diagonal angle α (=Δθ) of the movable angle Δθ with respect to the axis S.

The opening 23 is formed as a circular hole centered on the axis S to allow the bolt B to pass through.

The four screw holes 24 are formed to penetrate in the direction of the axis S in the regions of the four shoe portions 25.

The shoe portion 25 includes four shoe portions 25*a*, 25*b*, 25*c*, and 25*d* that protrude from the inner peripheral surface 21 of the cylindrical wall 20*a* toward the center (axis S) and are formed at intervals in the circumferential direction.

Also, the interval between the shoe portion 25*a* and the shoe portion 25*b* (circumferential length CL) is set larger than the interval between the shoe portion 25*b* and the shoe portion 25*c*, the interval between the shoe portion 25*c* and the shoe portion 25*d*, and the interval between the shoe portion 25*d* and the shoe portion 25*a*.

Further, the vane portion 11*a* of the vane rotor 10 is accommodated in the spatial region A defined by the pair of shoe portions 25*a* and 25*b* so as to be able to reciprocate. Furthermore, the shoe portion 25*a* has a stopper surface 25$a_1$ by which the vane rotor 10 is located at the most retarded position, and the shoe portion 25*b* has a stopper surface 25*b*$_1$ by which the vane rotor 10 is located at the most advanced position.

In addition, as shown in FIG. 8, the orthogonal line L that is orthogonal to the axis S and the biased axis S2 is located on a straight line D that is perpendicular to the axis S and passes through the center of the spatial region A defined by the pair of shoe portions 25*a* and 25*b*, that is, on the straight line D passing through a position that bisects the circumferential length CL of the spatial region A.

Thus, the housing member 20 is formed with a center of gravity eccentric from the axis S on the side opposite to the side where the imbalance amount of the vane rotor 10 occurs across the axis S, that is, on the side that relatively reduces the imbalance amount of the vane rotor 10.

The outer recess 26 is formed to define a semi-cylindrical surface extending from the outer peripheral surface 22 toward the axis S in the vicinity of each of the shoe portions 25*a*, 25*b*, 25*c*, and 25*d*.

The annular end surface 27 is formed at the rear end in the direction of the axis S and has a thickness defined by the inner peripheral surface 21 and the outer peripheral surface 22, and as shown in FIG. 8, the outer peripheral surface 22 is formed to be centered on the biased axis S2 that is biased in parallel to the axis S. Therefore, on the extension line (straight line D) of the orthogonal line L orthogonal to the axis S and the biased axis S2, the thinnest region is formed in the region sandwiched between the pair of shoe portions 25*a* and 25*b*, and the thickest region is formed in the region sandwiched between the pair of shoe portions 25*c* and 25*d*.

Figure 11:
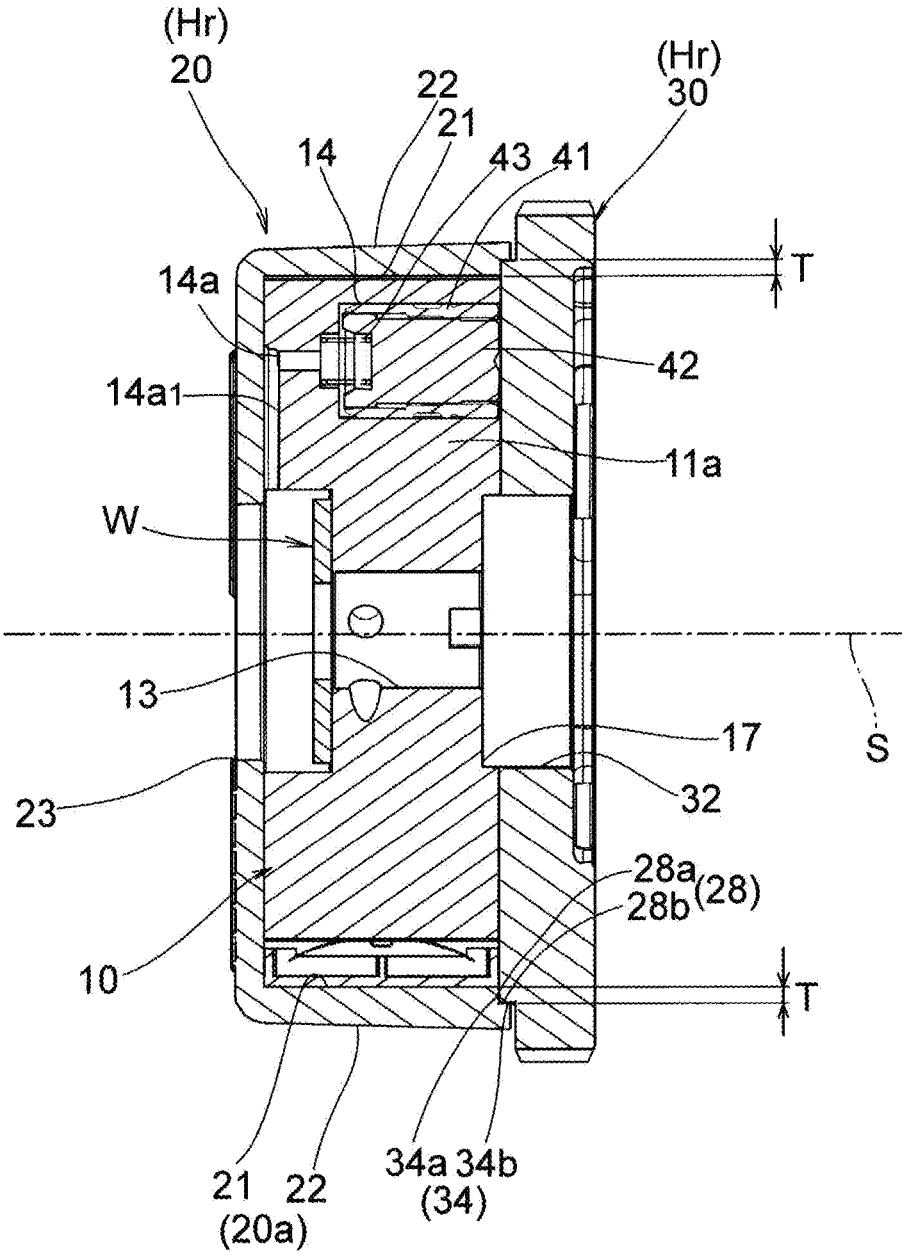
FIG. 11 is a cross-sectional view cut along a plane passing through the axis in the state shown in FIG. 9.

As shown in FIG. 11, the annular recess 28 is a region into which a disc-shaped protrusion 34 of the toothed member 30 is fitted, and defines an annular bottom surface 28*a* and an annular inner peripheral surface 28*b* perpendicular to the axis S.

The annular bottom surface 28*a* is a region that is in close contact with the end surface 34*a* of the disc-shaped protrusion 34 in the direction of the axis S, and has the same sealing width T in the entire area around the axis S.

The annular inner peripheral surface 28*b* is a region that is in close contact with an outer peripheral surface 34*b* of the disc-shaped protrusion 34 in the direction perpendicular to the axis S, and has the same sealing width in the direction of the axis S.

In this way, the sealing width of the annular recess 28 is maintained constant, so the desired sealing performance can be ensured regardless of the thickness of the annular end surface 27.

The toothed member 30 is formed into a disc shape as a sintered body using an iron-based metal material, and as shown in FIG. 3 to FIG. 7, the toothed member 30 includes a tooth row 31, a fitting inner peripheral surface 32, four circular holes 33 through which the screws b pass, the disc-shaped protrusion 34, a groove-shaped passage 35, a fitting hole 36, and a cutout portion 37.

A chain that transmits the rotational driving force of the crankshaft is wound around the tooth row 31 to apply the driving force thereto.

The fitting inner peripheral surface 32 is rotatably fitted to the shaft portion 1*a* of the camshaft 1.

The disc-shaped protrusion 34 protrudes further forward (toward the side of the housing member 20) than the tooth row 31 in the direction of the axis S, and defines the end surface 34*a* and the outer peripheral surface 34*b*.

The end surface 34*a* has a flat surface perpendicular to the axis S and is slidably in contact with the rear surface 10*b* which is the end surface of the vane rotor 10 in the direction of the axis S, and the outer peripheral edge region thereof is in close contact with the annular bottom surface 28*a* of the housing member 20.

The outer peripheral surface 34*b* is in close contact with the annular inner peripheral surface 28*b* of the housing member 20 in the direction perpendicular to the axis S.

The passage 35 is formed in a groove shape in the end surface 34*a* and communicates with the advance passage 16 (passages 16*a* and 16*b*) of the vane rotor 10 in order to supply and discharge hydraulic oil to and from the fitting hole 36.

The fitting hole 36 is formed in the end surface 34*a* so that the lock pin 42 included in the lock unit 40 can fit therein.

Figure 12:
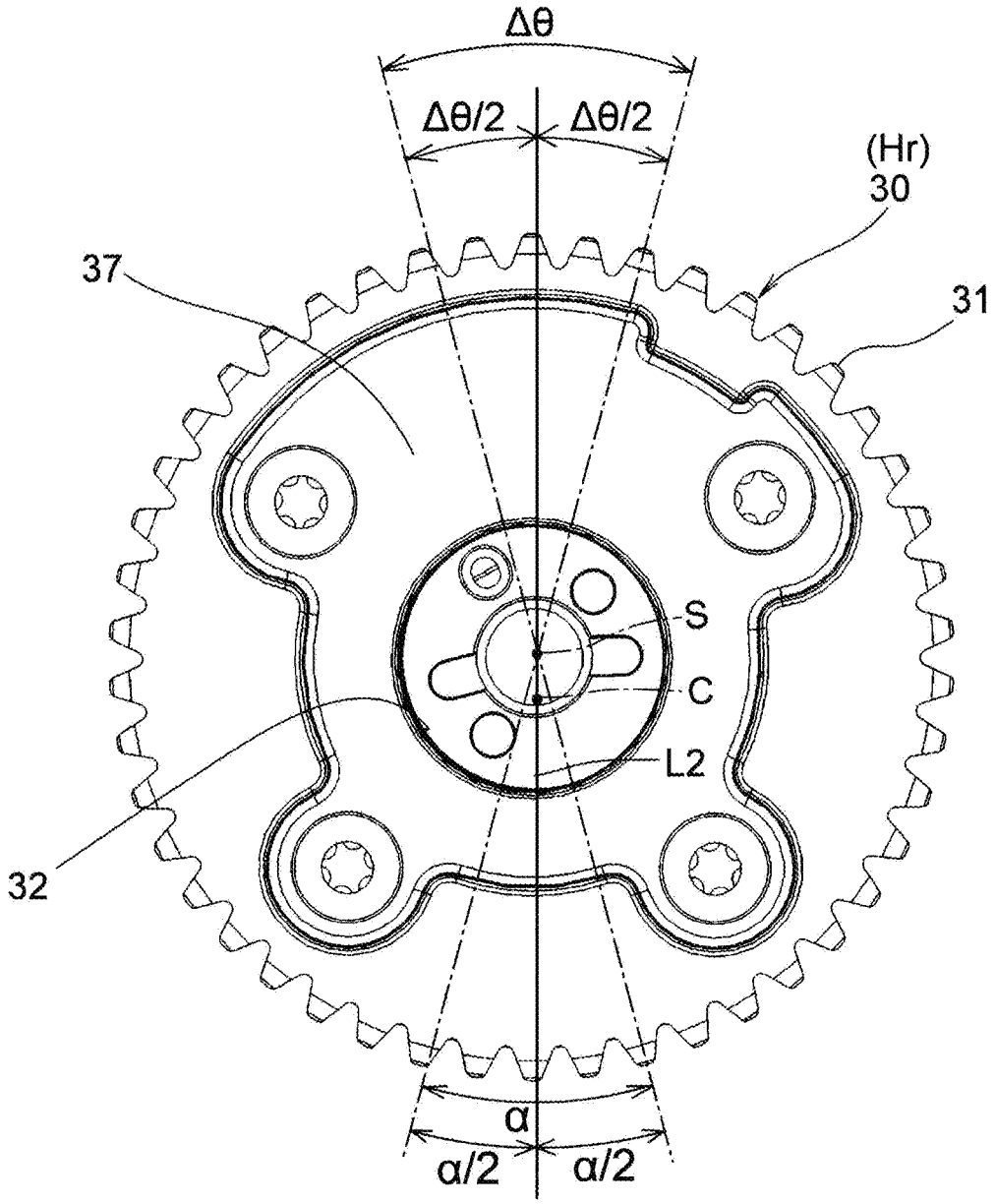
FIG. 12 is a rear view of the toothed member constituting the housing rotor, as viewed from the rear side in the axial direction, in a state where the vane rotor is located at the intermediate position in the valve timing changing device according to an embodiment.

As shown in FIG. 4 and FIG. 12, the cutout portion 37 is formed within the toothed member 30 in a form that is approximately line symmetrical with respect to an orthogonal line L2, which is parallel to the orthogonal line L and orthogonal to the axis S shown in FIG. 9, and is largely cut out on the side of the vane portion 11*a* where the lock unit 40 is arranged. That is, the cutout portion 37 is formed to relatively reduce the imbalance amount of the vane rotor 10.

The toothed member 30 having the above configuration has a center of gravity C located at the angular position in the center of the diagonal angle $\alpha$ (on the orthogonal line L2) within a region that forms the diagonal angle $\alpha$ with the movable angle $\Delta\theta$ with respect to the axis S, when viewed from the direction of the axis S, as shown in FIG. 12.

That is, the toothed member 30 is formed so that the center of gravity C is eccentric from the axis S on the side that relatively reduces the imbalance amount of the vane rotor 10.

Figure 5:
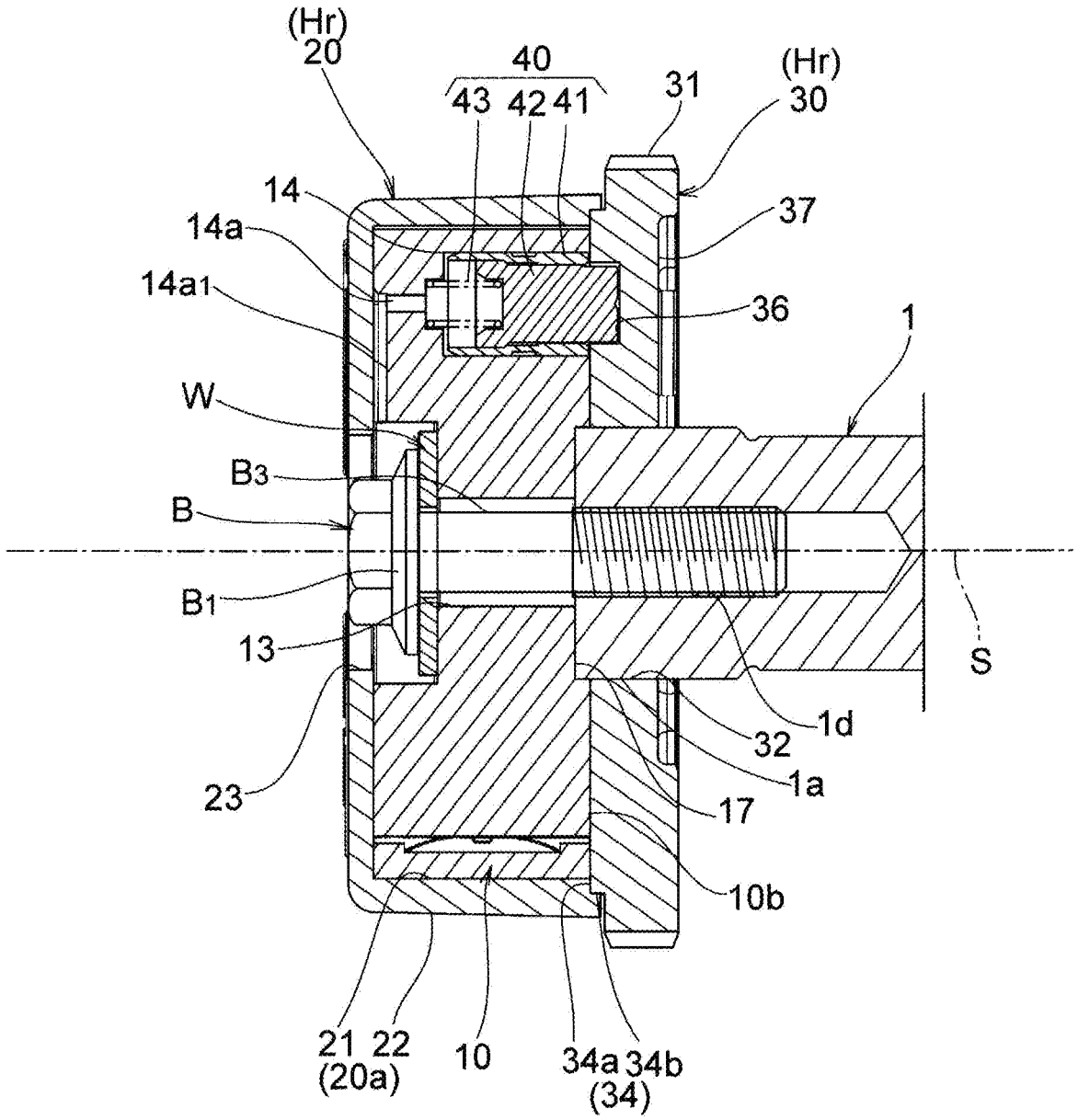
FIG. 5 is a cross-sectional view showing a state where the valve timing changing device according to an embodiment is mounted on the camshaft.
Figure 10:
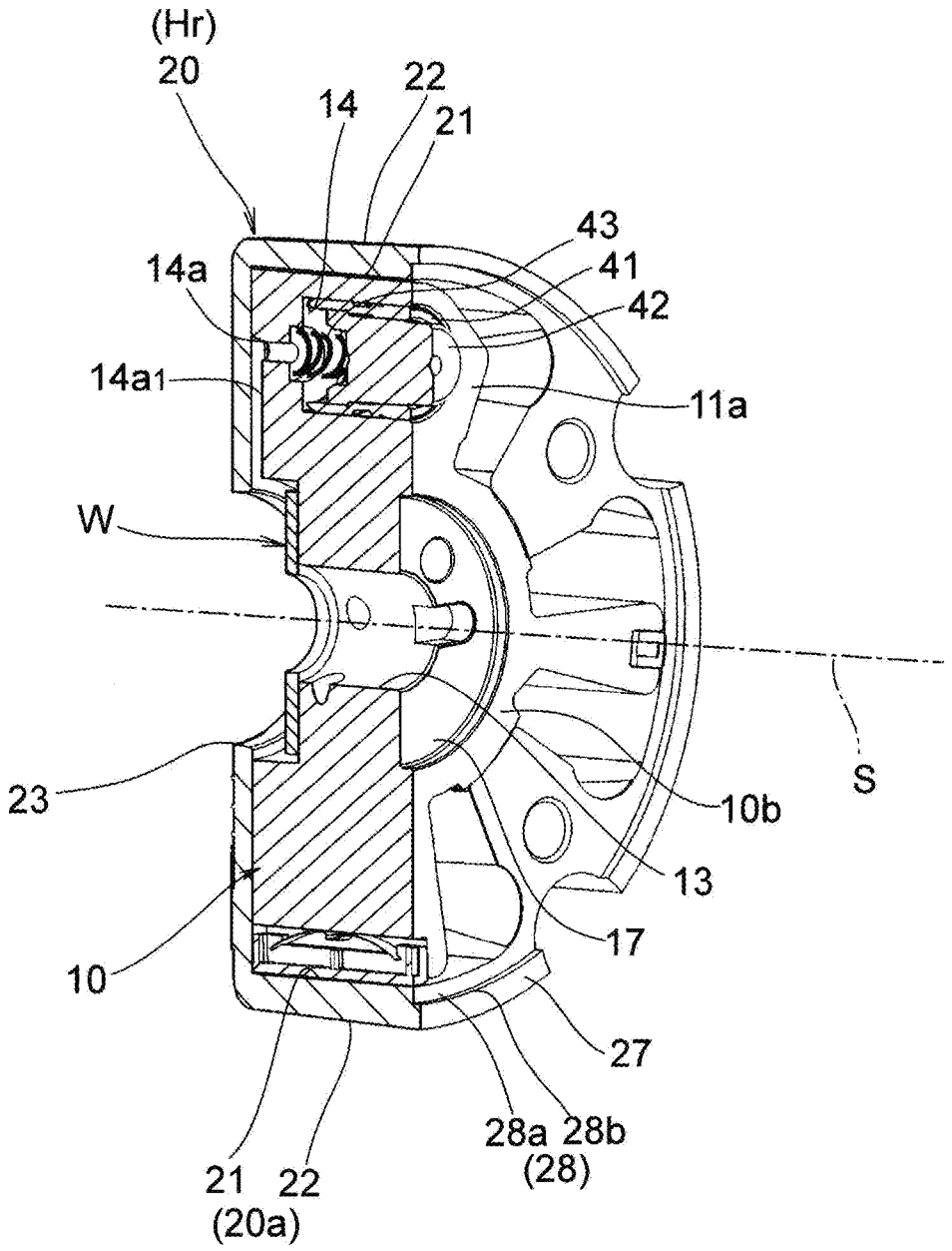
FIG. 10 is a perspective cross-sectional view cut along a plane passing through the axis in the state shown in FIG. 9.

As shown in FIG. 5 and FIG. 10, the lock unit 40 includes the cylindrical holder 41, the lock pin 42, and a coil spring 43.

The cylindrical holder 41 is fitted into the mounting hole 14 of the vane rotor 10 to reciprocally hold the lock pin 42 urged by the coil spring 43.

The lock pin 42 is capable of reciprocating in the direction of the axis S, and is formed to protrude from the rear surface 10*b* of the vane rotor 10 due to the urging force of the coil spring 43 and fit into the fitting hole 36 of the toothed member 30, and be buried in the vane rotor 10 in response to the hydraulic pressure of the hydraulic oil guided into the fitting hole 36 or the hydraulic pressure of the hydraulic oil guided through the passage 14*b*.

The coil spring 43 exerts an urging force in a direction that causes the lock pin 42 to protrude from the rear surface 10*b* of the vane rotor 10.

In the lock unit 40 having the above configuration, when the hydraulic pressure of the hydraulic oil supplied through the advance passage 16 and the passage 35 decreases and the hydraulic pressure of the hydraulic oil supplied through the passage 14*b* decreases, the lock pin 42 is fitted into the fitting hole 36 of the housing rotor 20 due to the urging force of the coil spring 43, and the vane rotor 10 is locked at the most retarded position with respect to the housing rotor Hr.

On the other hand, when the hydraulic pressure of the hydraulic oil guided through the advance passage 16 and the passage 35 becomes larger than the urging force of the coil spring 43, the lock pin 42 retracts from the rear surface 10*b* of the vane rotor 10, and the vane rotor 10 is unlocked. Further, when the hydraulic pressure of the hydraulic oil supplied through the passage 14*b* becomes larger than the urging force of the coil spring 43, the unlocked state is maintained.

Next, a method of assembling the valve timing changing device M will be described.

The vane rotor 10 in which the lock unit 40 has been assembled, the four sealing members 18*a*, the housing member 20, the toothed member 30, the washer W, and the four screws b are prepared in advance.

First, the vane rotor 10 with the washer W fitted into the annular recess $\mathbf{10}a_1$ is inserted into the accommodation chamber of the housing member 20. Then, the sealing members 18*a* are fitted into the four sealing insertion grooves 18 of the vane rotor 10, respectively.

Subsequently, the toothed member 30 is opposed to the housing member 20 so as to cover the rear surface 10*b* of the vane rotor 10, and the disc-shaped protrusion 34 is fitted into the annular recess 28. Then, the toothed member 30 is fixed to the housing member 20 by inserting the four screws b through the circular holes 33 and screwing the screws b into the screw holes 24.

With the above, the assembly of the valve timing changing device M is completed. It should be noted that the assembly procedure is not limited to the procedure described above, and other procedures may be used.

Figure 13:
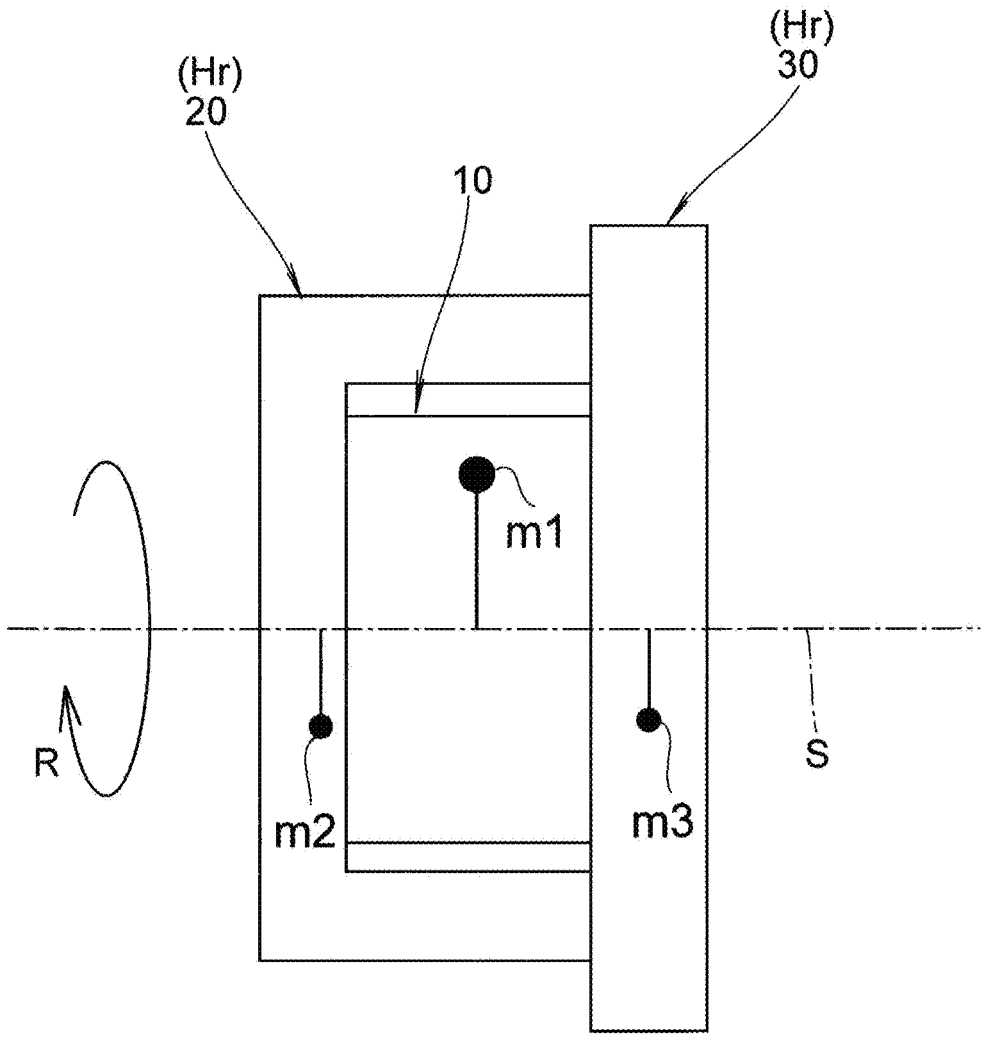
FIG. 13 is a schematic view showing the relationship between the centers of gravity of the vane rotor, the toothed member, and the housing member in the valve timing changing device according to an embodiment.

As described above, in the valve timing changing device M that has been assembled, the imbalance amounts around the axis S are as shown in FIG. 13 that the imbalance amount m1 of the vane rotor 10 occurs on one side across the axis S, and the imbalance amount m2 of the housing member 20 and the imbalance amount m3 of the toothed member 30 occur on the other side across the axis S.

That is, the housing member 20 is formed with the center of gravity eccentric from the axis S on the side that relatively reduces the imbalance amount m1 of the vane rotor 10, and the toothed member 30 is formed with the center of gravity C eccentric from the axis S on the side that relatively reduces the imbalance amount m1 of the vane rotor 10.

Figure 14:
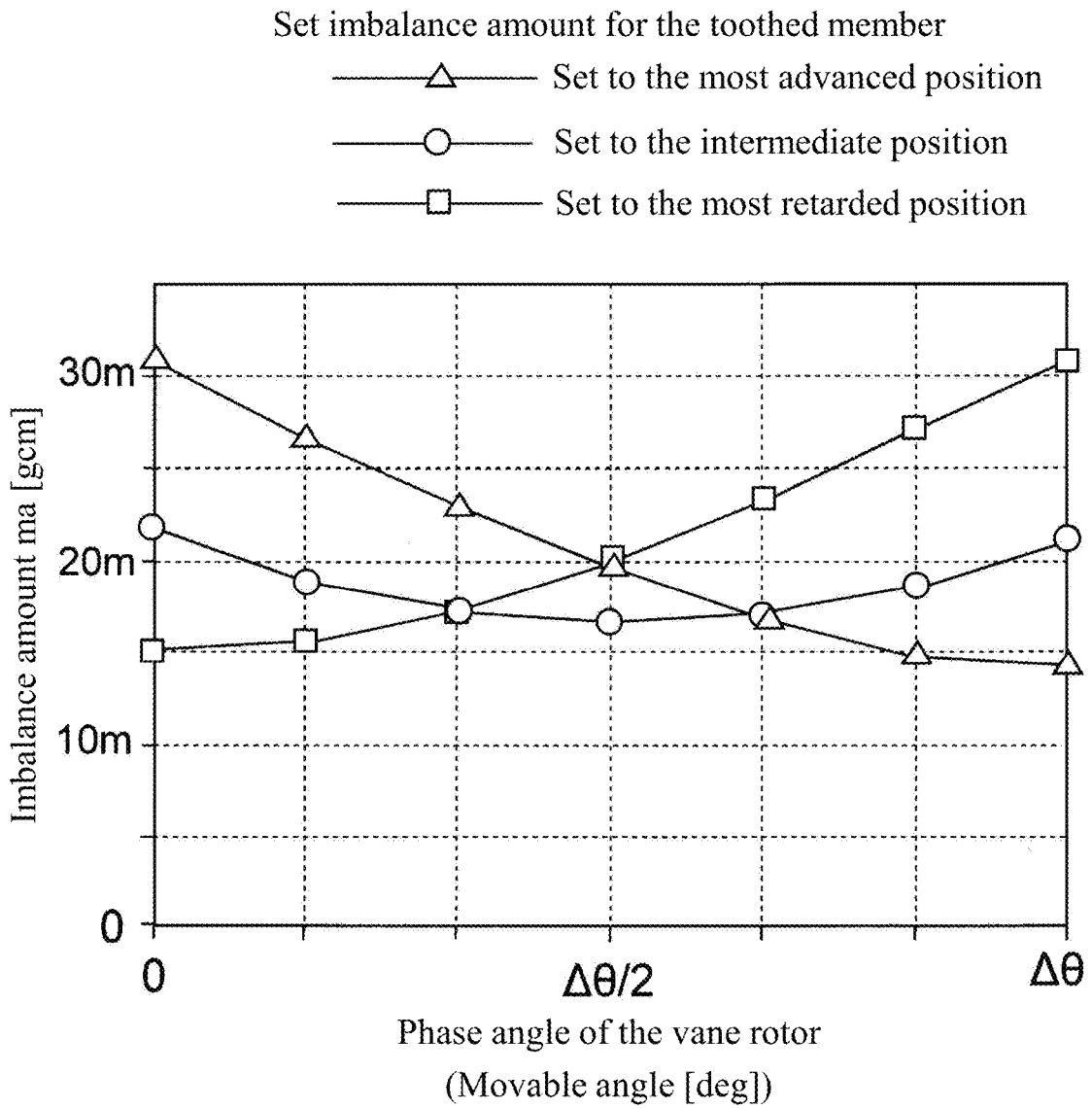
FIG. 14 is a graph showing the change in the imbalance amount of the entire device for each phase angle when the center of gravity of the toothed member is located at the most retarded position, the intermediate position, and the most advanced position in the range of the movable angle in the valve timing changing device according to an embodiment.

Here, selection of the arrangement position of the imbalance amount m3 of the toothed member 30 with respect to the imbalance amount m1 of the vane rotor 10 will be described with reference to FIG. 14. FIG. 14 shows the imbalance amount ma of the valve timing changing device M in the case where only the imbalance amount m3 of the toothed member 30 is provided against the imbalance amount m1 of the vane rotor 10.

In the case of form 1 in which the imbalance amount m3 is provided on the side that relatively reduces the imbalance amount m1 in the state where the vane rotor 10 is located at the most retarded position (phase angle 0 deg) (graph marked with □), the imbalance amount ma of the valve timing changing device M is smallest at the most retarded position (0 deg) and largest at the most advanced position (Δθ deg).

In the case of form 2 in which the imbalance amount m3 is provided on the side that relatively reduces the imbalance amount m1 in the state where the vane rotor 10 is located at the most advanced position (phase angle Δθ deg) (graph marked with Δ), the imbalance amount ma of the valve timing changing device M is largest at the most retarded position (0 deg) and smallest at the most advanced position (Δθ deg).

On the other hand, in the case of form 3 in which the imbalance amount m3 is provided on the side that relatively reduces the imbalance amount m1 in the state where the vane rotor 10 is located at the intermediate position (phase angle Δθ/2 deg) (graph marked with ○), the imbalance amount ma of the valve timing changing device M is largest at the most retarded position (0 deg) and the most advanced position (Δθ deg) and smallest at the intermediate position (phase angle Δθ/2 deg), and the maximum value of the imbalance amount ma is smaller than in form 1 and form 2.

Accordingly, as the position for setting the imbalance amount m3 of the toothed member 30, it is preferable to use the form in which the imbalance amount m3 is arranged on the opposite side of the imbalance amount m1 with respect to the axis S in the state where the vane rotor 10 is located at the center of the movable angle Δθ, that is, at the intermediate position between the most retarded position and the most advanced position.

That is, the center of gravity C of the toothed member 30 is preferably located at an angular position α/2 (=Δθ/2) in the center of the diagonal angle α in the region that forms the diagonal angle α with the movable angle Δθ.

Next, the arrangement positions of the imbalance amount m2 of the housing member 20 and the imbalance amount m3 of the toothed member 30 with respect to the imbalance amount m1 of the vane rotor 10 will be described with reference to FIG. 15.

Figure 15:
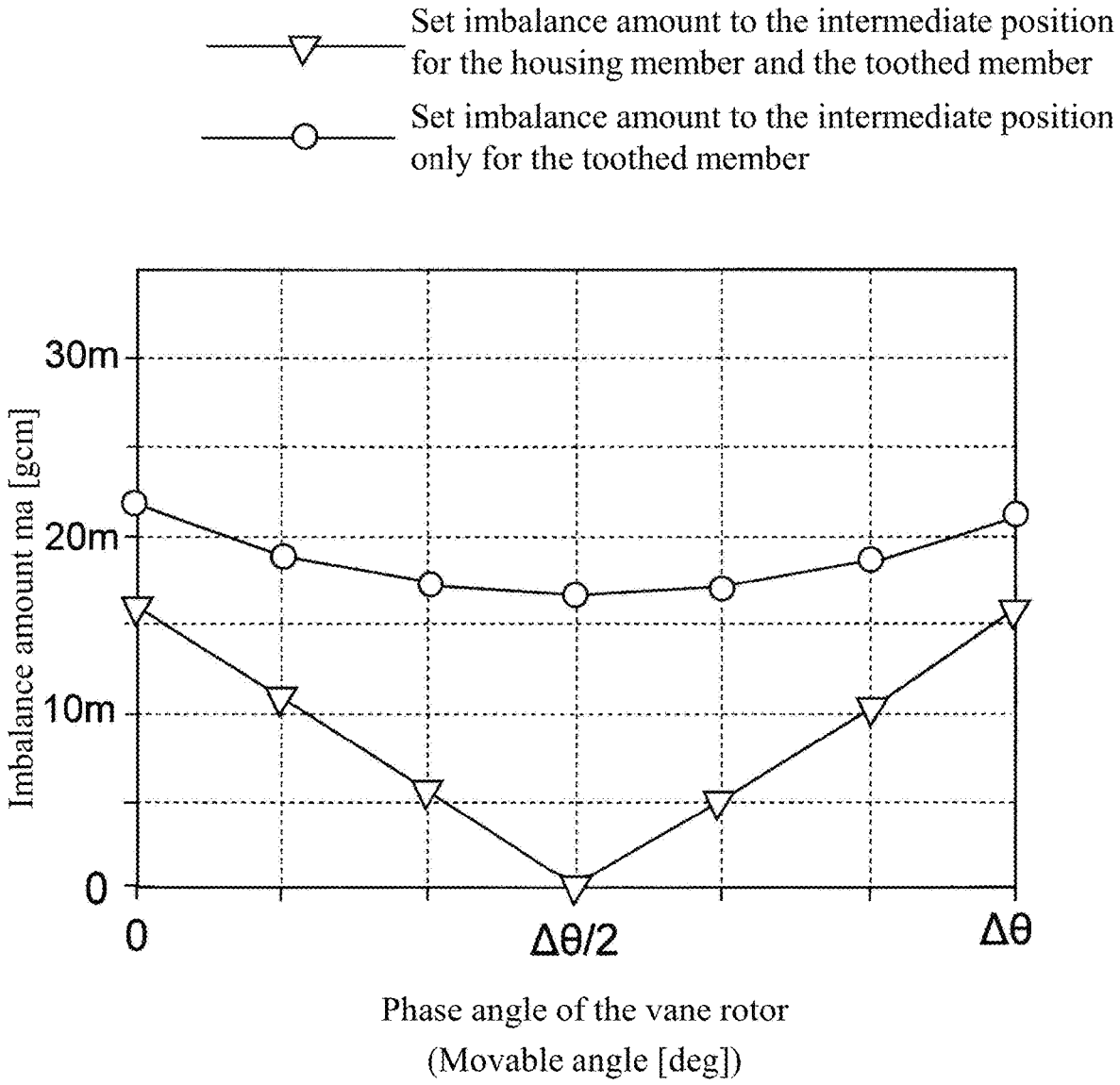
FIG. 15 is a graph showing the change in the imbalance amount of the entire device for each phase angle when the centers of gravity of the toothed member and the housing member are located at the intermediate position of the angle range in the valve timing changing device according to an embodiment.

In addition to the imbalance amount m3 of the toothed member 30 arranged at the intermediate position shown in FIG. 14, similarly, FIG. 15 shows the imbalance amount ma of the valve timing changing device M in the case where the imbalance amount m2 of the housing member 20 is set to the intermediate position (graph marked with ▽). For comparison, the result of setting only the imbalance amount m3 of the toothed member 30 to the intermediate position (graph marked with ○) is also shown.

As is clear from FIG. 15, the imbalance amount ma of the valve timing changing device M is largest at the most retarded position (0 deg) and the most advanced position (Δθ deg), and smallest at the intermediate position (phase angle Δθ/2 deg), and compared to form 3 in which only the imbalance amount m3 of the toothed member 30 is provided (graph marked with ○), both the maximum value and the minimum value of the imbalance amount ma can be reduced.

According to this, by providing the imbalance amount m2 of the housing member 20 and the imbalance amount m3 of the toothed member 30 against the imbalance amount m1 of the vane rotor 10, the imbalance amount ma of the valve timing changing device M can be reduced as a whole, and the imbalance amount ma can be eliminated especially in the operating state where the phase angle is at the intermediate position.

Next, the operation of the valve timing changing device M will be described with reference to FIG. 16 to FIG. 18.

In the state where the internal combustion engine is stopped, the hydraulic oil in the advance chamber AC and the retard chamber RC is discharged, and the vane rotor 10 is located at the most retarded position, as shown in FIG. 16.

Further, the lock pin 42 of the lock unit 40 is fitted into the fitting hole 36 (see FIG. 5), and the vane rotor 10 is in a state of being locked to the housing rotor Hr.

Thus, when starting the internal combustion engine, it is possible to start the internal combustion engine smoothly while preventing the vane rotor 10 from fluttering or the like.

Subsequently, when hydraulic oil is supplied to the tip of the lock pin 42 through the advance passage 16 and the passage 35 by starting the internal combustion engine, the lock pin 42 is pressed and disengaged from the fitting hole 36, thereby releasing the locked state.

After starting the internal combustion engine, the hydraulic control valve 2*a* is switched as appropriate, and phase control is performed so that the vane rotor 10 and the camshaft 1 are held to the advance side, the retard side, or at a predetermined angular position, for example, at the intermediate position shown in FIG. 17.

For example, in the case where the internal combustion engine is in a high load operation mode, the hydraulic oil in the retard chamber RC is discharged through the retard passage 15 and the retard side passage 2*c*, and the hydraulic oil is supplied into the advance chamber AC through the advance side passage 2*b* and the advance passage 16.

Thus, the vane rotor 10 rotates clockwise with respect to the housing rotor Hr, that is, to the advance side, as shown in FIG. 18, due to the hydraulic pressure of the hydraulic oil in the advance chamber AC.

Furthermore, in the case where the internal combustion engine is in a medium load operation mode, the operation of discharging the hydraulic oil in the advance chamber AC through the advance passage 16 and the advance side passage 2*b*, as well as the operation of supplying the hydraulic oil into the retard chamber RC through the retard side passage 2*c* and the retard passage 15 are controlled appropriately.

For example, in the case of a holding mode in which the vane rotor 10 is held at the intermediate position between the most advanced position and the most retarded position, the hydraulic control valve 2*a* is switched, hydraulic oil is supplied into the advance chamber AC and the retard chamber RC, and the vane rotor 10 is held at the intermediate position, as shown in FIG. 17, by the hydraulic pressure of the hydraulic oil in the advance chamber AC and the retard chamber RC.

The medium load operation mode is generally a region that is used more frequently than the high load operation mode, and since the imbalance amount ma of the valve timing changing device M is small or eliminated in this state, smooth rotational operation can be achieved without vibration or the like.

On the other hand, in the case where the internal combustion engine is in a low load operation mode, the hydraulic oil in the advance chamber AC is discharged through the advance passage 16 and the advance side passage 2*b*, and the hydraulic oil is supplied into the retard chamber RC through the retard side passage 2*c* and the retard passage 15.

Thus, the vane rotor 10 rotates counterclockwise with respect to the housing rotor Hr, that is, to the retard side, as shown in FIG. 16, due to the hydraulic pressure of the hydraulic oil in the retard chamber RC.

In addition, in the case where the vane rotor 10 moves to the most retarded position, although the lock pin 42 faces the fitting hole 36, the hydraulic oil in the retard chamber RC acts in a direction to bury the lock pin 42 through the passage 14*b*, so the lock pin 42 remains in the unlocked state without being fitted into the fitting hole 36.

The valve timing changing device M according to the above embodiment includes the vane rotor 10 that rotates integrally with the camshaft 1 around the axis S of the camshaft 1 and includes the lock pin 42, and the housing rotor Hr that is rotatable relative to the vane rotor 10 around the axis S within the range of the predetermined movable angle Δθ and whose relative rotation is locked by the lock pin 42. The housing rotor Hr includes the toothed member 30 having the tooth row 31 to which a driving force is applied, and a bottomed cylindrical housing member 20 fixed to the toothed member 30 and accommodating the vane rotor 10. The housing member 20 is formed so that the center of gravity thereof is eccentric from the axis S on the side that relatively reduces the imbalance amount m1 of the vane rotor 10.

According to this, the imbalance amount ma of the valve timing changing device M as a whole can be reduced.

Moreover, since the housing member 20 has the inner peripheral surface 21 centered on the axis S and the outer peripheral surface 22 centered on the biased axis S2 that is biased in parallel to the axis S, in order to define the cylindrical wall 10*a*, compared to a form in which the inner peripheral surface and the outer peripheral surface have centers on the axis, the imbalance amount m1 can be relatively reduced to reduce the imbalance amount ma of the valve timing changing device M without increasing the size and weight.

Further, the vane rotor 10 has the vane portion 11*a* in which the lock pin 42 is arranged and which can move within the range of the movable angle Δθ, and the orthogonal line L orthogonal to the axis S and the biased axis S2 is located within the region that forms the diagonal angle α with the movable angle Δθ with respect to the axis S, and in particular, by positioning the orthogonal line L at the angular position in the center of the diagonal angle α, the imbalance amount ma of the valve timing changing device M can be further reduced.

In addition, the vane rotor 10 has the vane portion 11*a* in which the lock pin 42 is arranged, and the housing member 20 has the pair of shoe portions 11*a* and 11*b* that protrude from the inner peripheral surface 21 to restrict movement of the vane portion 11*a* within the range of movable angle Δθ. The orthogonal line L that is orthogonal to the axis S and the biased axis S2 is located on the straight line D that is perpendicular to the axis S and passes through the center of the spatial region A defined by the pair of shoe portions 11*a* and 11*b*.

According to this, the imbalance amount m2 that relatively reduces the imbalance amount m1 of the vane rotor 10 can be set by simply manufacturing the housing member 20 to satisfy the above conditions.

Further, the toothed member 30 has the disc-shaped protrusion 34 that protrudes in the direction of the axis S. The housing member 20 has the annular recess 28 into which the disc-shaped protrusion 34 is fitted, and the outer peripheral surface 22 is formed in the outer region outside the annular recess 28.

According to this, even if there is a region where the thickness of the cylindrical wall 10*a* defined by the inner peripheral surface 21 and the outer peripheral surface 22 is reduced, the sealing width between the housing member 20 and the toothed member 30 can be maintained at the constant sealing width T around the entire circumference, so the sealing function can be guaranteed to prevent leakage of hydraulic oil from the joint surface.

The toothed member 30 is formed so that the center of gravity C is eccentric from the axis S on the side that relatively reduces the imbalance amount m1 of the vane rotor 10, and specifically, the toothed member 30 has the cutout portion 37 formed to relatively reduce the imbalance amount m1. Thus, the center of gravity C of the toothed member 30 is located within the region that forms the diagonal angle α with the movable angle Δθ with respect to the axis S, in particular, located at the angular position in the center of the diagonal angle α.

According to this, in addition to the imbalance amount m2 of the housing member 20, the imbalance amount m3 of the toothed member 30 can be provided at a position that effectively reduces the imbalance amount m1 of the vane rotor 10, and the imbalance amount ma of the valve timing changing device M can be further reduced or eliminated.

Although the above embodiment illustrates that the center of the outer peripheral surface 22 is biased from the axis S as a form of providing the imbalance amount m2 in the housing member 20, the disclosure is not limited thereto, and the imbalance amount may also be set in other forms.

Although in the above embodiment, the positions of the imbalance amount m2 of the housing member 20 and the imbalance amount m3 of the toothed member 30 are set corresponding to the state where the vane rotor 10 is located at the intermediate position between the most retarded position and the most advanced position, the disclosure is not limited thereto, and the positions may be set corresponding to any angular position between the most retarded position and the most advanced position.

Although the above embodiment illustrates the lock unit 40 that includes the cylindrical holder 41, the lock pin 42, and the coil spring 43 and locks at the most retarded position as the lock unit, the disclosure is not limited thereto. For example, other lock units may be employed as long as the configuration can lock the relative rotation between the vane rotor 10 and the housing rotor Hr, and the locked position is not limited to the most retarded position and may be the most advanced position or other positions as necessary.

As described above, the valve timing changing device of the disclosure is capable of reducing the imbalance amount with a simple structure without increasing the size and weight, and therefore is not only applicable to the internal combustion engine installed in an automobile or the like but also useful for the small internal combustion engine installed in a motorcycle or the like and the internal combustion engine installed in other vehicles or ships.

What is claimed is:

1. A valve timing changing device for adjusting an opening/closing timing of an intake valve or an exhaust valve driven by a camshaft, the valve timing changing device comprising:

a vane rotor that rotates integrally with the camshaft about a camshaft axis of the camshaft; and a housing rotor that rotates about the camshaft axis, the housing rotor configured to rotate relative to the vane rotor within a predetermined angular range, wherein the vane rotor includes a lock pin configured to selectively lock the relative rotation between the vane rotor and the housing rotor, wherein the housing rotor comprises:

a toothed member with a tooth row configured to receive a driving force, and a bottomed cylindrical housing member fixed to the toothed member so as to accommodate the vane rotor, wherein the housing member is formed with (i) an inner peripheral surface centered about the camshaft axis, and (ii) an outer peripheral surface centered about a biased axis which is offset from the camshaft axis such that a center of gravity of the housing member is eccentric from the camshaft axis, and wherein the center of gravity of the housing member is positioned so as to counteract a portion of an imbalance amount of the vane rotor caused by the lock pin.

2. The valve timing changing device according to claim 1, wherein the toothed member is formed with a center of gravity eccentric from the camshaft axis, the center of gravity of the toothed member positioned so as to counteract a remaining portion of the imbalance amount of the vane rotor.

3. The valve timing changing device according to claim 1, wherein the vane rotor further comprises a vane portion in which the lock pin is arranged, the vane portion configured to move within the predetermined angular range, and wherein a straight line extends through the camshaft axis, the biased axis, and a path of the vane portion across the predetermined angular range.

4. The valve timing changing device according to claim 3, wherein the toothed member is formed with a center of gravity eccentric from the camshaft axis, the center of gravity of the toothed member positioned so as to counteract a remaining portion of the imbalance amount of the vane rotor.

5. The valve timing changing device according to claim 3, wherein the straight line bisects the path of the vane portion.

6. The valve timing changing device according to claim 5, wherein the toothed member is formed with a center of gravity eccentric from the camshaft axis, the center of gravity of the toothed member positioned so as to counteract a remaining portion of the imbalance amount of the vane rotor.

7. The valve timing changing device according to claim 1, wherein the vane rotor further comprises a vane portion in which the lock pin is arranged, wherein the housing member comprises a pair of shoe portions which protrude from the inner peripheral surface, so as to delimit a path of the vane portion across the predetermined angular range, and wherein a straight line extends through the camshaft axis, the biased axis, and a center of the path of the vane portion.

8. The valve timing changing device according to claim 7, wherein the toothed member is formed with a center of gravity eccentric from the camshaft axis, the center of gravity of the toothed member positioned so as to counteract a remaining portion of the imbalance amount of the vane rotor.

9. The valve timing changing device according to claim 1, wherein the toothed member comprises a disc-shaped protrusion which protrudes axially towards the housing member, wherein the housing member comprises an annular recess into which the disc-shaped protrusion is fitted, and wherein the outer peripheral surface encloses the annular recess.

10. The valve timing changing device according to claim 9, wherein the toothed member is formed with a center of gravity eccentric from the camshaft axis, the center of gravity of the toothed member positioned so as to counteract a remaining portion of the imbalance amount of the vane rotor.

11. The valve timing changing device according to claim 1, wherein the vane rotor is made of an aluminum material, wherein the toothed member is made of an iron-based material, and wherein the housing member is made of an aluminum material.

12. The valve timing changing device according to claim 1, wherein the predetermined angular range includes a first end defining a most retarded position, and a second end defining a most advanced position, and wherein the lock pin locks the housing member at the most retarded position.

13. A valve timing changing device for adjusting an opening/closing timing of a gas exchange valve driven by a camshaft, the valve timing changing device comprising:

a vane rotor that rotates integrally with the camshaft about a camshaft axis of the camshaft; and a housing rotor that rotates about the camshaft axis, the housing rotor configured to rotate relative to the vane rotor within a predetermined angular range, wherein the vane rotor includes a lock pin configured to selectively lock the relative rotation between the vane rotor and the housing rotor, wherein the housing rotor includes:

a toothed member with a tooth row configured to receive a driving force, and a bottomed cylindrical housing member fixed to the toothed member so as to accommodate the vane rotor, wherein the toothed member is formed with a center of gravity eccentric from the camshaft axis, the center of gravity of the toothed member positioned so as to counteract a portion of an imbalance amount of the vane rotor caused by the lock pin, and wherein the housing member is formed with a center of gravity eccentric from the camshaft axis, the center of gravity of the housing member positioned so as to counteract a remaining portion of the imbalance amount of the vane rotor.

14. The valve timing changing device according to claim 13, wherein the toothed member comprises a cutout portion which causes the center of gravity of the toothed member to be eccentric from the camshaft axis.

* * * * *